US011107412B2

(12) United States Patent
Chen et al.

(10) Patent No.: US 11,107,412 B2
(45) Date of Patent: Aug. 31, 2021

(54) PIXEL DRIVING CIRCUIT, PIXEL DRIVING METHOD, DISPLAY PANEL AND DISPLAY APPARATUS

(71) Applicant: BOE TECHNOLOGY GROUP CO., LTD., Beijing (CN)

(72) Inventors: Yipeng Chen, Beijing (CN); Libin Liu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/882,123

(22) Filed: May 22, 2020

(65) Prior Publication Data

US 2020/0410937 A1 Dec. 31, 2020

(30) Foreign Application Priority Data

Jun. 27, 2019 (CN) ..... 201910570510.5

(51) Int. Cl.
*G09G 3/3258* (2016.01)
*G09G 3/3266* (2016.01)
*G09G 3/3275* (2016.01)

(52) U.S. Cl.
CPC ..... *G09G 3/3258* (2013.01); *G09G 3/3266* (2013.01); *G09G 3/3275* (2013.01); *G09G 2300/043* (2013.01)

(58) Field of Classification Search
CPC ..... G09G 3/3266; G09G 2310/0283; G09G 2320/0693; G09G 2310/062;
(Continued)

(56) References Cited

U.S. PATENT DOCUMENTS

2003/0132931 A1 7/2003 Kimura et al.
2011/0115764 A1 5/2011 Chung
(Continued)

FOREIGN PATENT DOCUMENTS

CN 104867442 A 8/2015
CN 106205486 A 12/2016
(Continued)

OTHER PUBLICATIONS

First Office Action for related CN App. No. 201910570510.5 dated May 29, 2020 English translation provided; 37 pages.
(Continued)

*Primary Examiner* — Md Saiful A Siddiqui
(74) *Attorney, Agent, or Firm* — Procopio, Cory, Hargreaves & Savitch LLP

(57) ABSTRACT

A pixel driving circuit includes a driving sub-circuit, a data writing sub-circuit, a compensation sub-circuit and a light-emitting control sub-circuit. The driving sub-circuit is configured to drive the light-emitting device. The data writing sub-circuit is configured to write a data signal to the driving sub-circuit. The compensation sub-circuit is configured to compensate a voltage of the driving sub-circuit. The compensation sub-circuit includes a first switching transistor whose gate is electrically connected to the scanning signal terminal, first electrode is electrically connected to a first terminal of the driving sub-circuit and second electrode is electrically connected to a second terminal of the driving sub-circuit. The first switching transistor is an indium gallium zinc oxide thin film transistor. The light-emitting control sub-circuit is electrically connected to the driving sub-circuit and configured to turn on a line between a first voltage terminal and a second voltage terminal.

11 Claims, 13 Drawing Sheets

(58) Field of Classification Search
CPC ..... G09G 2320/0233; G09G 3/325; G09G 3/3283; G09G 3/064; G09G 3/3258; G09G 3/2092; G09G 3/3291
See application file for complete search history.

(56) References Cited

U.S. PATENT DOCUMENTS

| | | | | |
|---|---|---|---|---|
| 2016/0063922 | A1* | 3/2016 | Tsai | G09G 3/3291 345/76 |
| 2016/0351122 | A1* | 12/2016 | Jung | G09G 3/2085 |
| 2018/0268760 | A1* | 9/2018 | Chen | G09G 3/3258 |

FOREIGN PATENT DOCUMENTS

| | | | | |
|---|---|---|---|---|
| CN | 106611585 | A | | 5/2017 |
| CN | 106782323 | A | * | 5/2017 |
| CN | 107230452 | A | | 10/2017 |

OTHER PUBLICATIONS

Second Office Action for related CN App. No. 201910570510.5 dated Nov. 12, 2020 English translation provided; 33 pages.

* cited by examiner

PIXEL DRIVING CIRCUIT, PIXEL DRIVING METHOD, DISPLAY PANEL AND DISPLAY APPARATUS

CROSS-REFERENCE TO RELATED APPLICATION

This application claims priority to Chinese Patent Application No. 201910570510.5, filed on Jun. 27, 2019, which is incorporated herein by reference in its entirety.

TECHNICAL FIELD

The present disclosure relates to the field of display technologies, and in particular, to a pixel driving circuit, a pixel driving method, a display panel and a display apparatus.

BACKGROUND

Organic light-emitting diode (OLEO) display apparatus are a kind of self-luminous display apparatus, Compared with traditional liquid crystal apparatus, the OLED display apparatus have a wider viewing angle, a higher refresh rate and a thinner size.

SUMMARY

In one aspect, a pixel driving circuit is provided. The pixel driving circuit includes a driving sub-circuit, a data writing sub-circuit, a compensation sub-circuit, and a light-emitting control sub-circuit. The driving sub-circuit is configured to drive a light-emitting device to emit light. The data writing sub-circuit is electrically connected to the driving sub-circuit, and is configured to write a data signal from a data signal terminal to the driving sub-circuit in response to a scanning signal from a scanning signal terminal. The compensation sub-circuit is electrically connected to the driving sub-circuit, and is configured to compensate a voltage of the driving sub-circuit in response to the scanning signal. The compensation sub-circuit includes a first switching transistor. A gate of the first switching transistor is electrically connected to the scanning signal terminal, a first electrode of the first switching transistor is electrically connected to a first terminal of the driving sub-circuit, and a second electrode of the first switching transistor is electrically connected to a second terminal of the driving sub-circuit. The first switching transistor is an indium gallium zinc oxide thin film transistor. The light-emitting control sub-circuit is electrically connected to the driving sub-circuit, and is configured to turn on a line, on which the light-emitting device is located, between a first voltage terminal and a second voltage terminal in response to a light-emitting signal from a light-emitting signal terminal, so as to allow the driving sub-circuit to drive the light-emitting device to emit light.

In some embodiments, the pixel driving circuit further includes a first reset sub-circuit. The first reset sub-circuit is electrically connected to the driving sub-circuit, and the first reset sub-circuit is configured to transmit a first voltage signal from the first voltage terminal to the first terminal of the driving sub-circuit in response to a first reset signal from a first reset signal terminal. The first reset sub-circuit includes a second switching transistor. A gate of the second switching transistor is electrically connected to the first reset signal terminal, a first electrode of the second switching transistor is electrically connected to the first voltage terminal, and a second electrode of the second switching transistor is electrically connected to the first terminal of the driving sub-circuit. The second switching transistor is an indium gallium zinc oxide thin film transistor.

In some embodiments, the pixel driving circuit further includes a second reset sub-circuit electrically connected to a third terminal of the driving sub-circuit. The second reset sub-circuit is configured to transmit an initialization voltage signal from an initialization voltage signal terminal to the third terminal of the driving sub-circuit and a first electrode of the light-emitting device in response to one of the first reset signal, a second reset signal from a second reset signal terminal and the light-emitting signal.

In some embodiments, the second reset sub-circuit is capable of being responsive to the first reset signal. The second reset sub-circuit includes a third switching transistor. A gate of the third switching transistor is electrically connected to the first reset signal terminal, a first electrode of the third switching transistor is electrically connected to the initialization voltage signal terminal, and a second electrode of the third switching transistor is electrically connected to the third terminal of the driving sub-circuit.

In some embodiments, the second reset sub-circuit is capable of being responsive to the second reset signal. The second reset sub-circuit includes a third switching transistor. A gate of the third switching transistor is electrically connected to the second reset signal terminal, a first electrode of the third switching transistor is electrically connected to the initialization voltage signal terminal, and a second electrode of the third switching transistor is electrically connected to the third terminal of the driving sub-circuit.

In some embodiments, the data writing sub-circuit includes a fourth switching transistor. A gate of the fourth switching transistor is electrically connected to the scanning signal terminal, a first electrode of the fourth switching transistor is electrically connected to the data signal terminal, and a second electrode of the fourth switching transistor is electrically connected to a fourth terminal of the driving sub-circuit.

In some embodiments, the driving sub-circuit includes a driving transistor and a capacitor. A gate of the driving transistor is electrically connected to a first terminal of the capacitor and the first reset sub-circuit, a first electrode of the driving transistor is electrically connected to the data writing sub-circuit and a first terminal of the light-emitting control sub-circuit, and a second electrode of the driving transistor is electrically connected to a second terminal of the light-emitting control sub-circuit and a second terminal of the compensation sub-circuit. The first terminal of the capacitor is further electrically connected to a first terminal of the compensation sub-circuit, and a second terminal of the capacitor is electrically connected to the first electrode of the light-emitting device and the second reset sub-circuit.

In some embodiments, the light-emitting control sub-circuit includes a fifth switching transistor and a sixth switching transistor. A gate of the fifth switching transistor is electrically connected to the light-emitting signal terminal, a first electrode of the fifth switching transistor is electrically connected to the first voltage terminal, and a second electrode of the fifth switching transistor is electrically connected to a fourth terminal of the driving sub-circuit. A gate of the sixth switching transistor is electrically connected to the light-emitting signal terminal, a first electrode of the sixth switching transistor is electrically connected to the second terminal of the driving sub-circuit, and a second electrode of the sixth switching transistor is electrically connected to the first electrode of the light-emitting device.

In some embodiments, the second reset sub-circuit is capable of being responsive to the light-emitting signal. The second reset sub-circuit includes a third switching transistor. A gate of the third switching transistor is electrically connected to the light-emitting signal terminal, a first electrode of the third switching transistor is electrically connected to the initialization voltage signal terminal, and a second electrode of the third switching transistor is electrically connected to the third terminal of the driving sub-circuit.

In some embodiments, the third switching transistor is one of a P-type thin film transistor or an N'-type thin film transistor, and each of the fifth switching transistor and the sixth switching transistor is another of the P-type thin film transistor and the N-type thin film transistor.

In some embodiments, the second reset sub-circuit includes a third switching transistor, the data writing sub-circuit includes a fourth switching transistor, the light-emitting control sub-circuit includes a fifth switching transistor and a sixth switching transistor, and the driving sub-circuit includes a driving transistor and a capacitor. The second electrode of the first switching transistor is electrically connected to a second electrode of the driving transistor, and the first electrode of the first switching transistor is electrically connected to a first terminal of the capacitor. The second electrode of the second switching transistor is electrically connected to a gate of the driving transistor and the first terminal of the capacitor. A gate of the third switching transistor is electrically connected to one of the first reset signal terminal, the second reset signal terminal and the light-emitting signal terminal, a first electrode of the third switching transistor is electrically connected to the initialization voltage signal terminal, and a second electrode of the third switching transistor is electrically connected to a second terminal of the capacitor and the first electrode of the light-emitting device. A gate of the fourth switching transistor is electrically connected to the scanning signal terminal, a first electrode of the fourth switching transistor is electrically connected to the data signal terminal, and a second electrode of the fourth switching transistor is electrically connected to a first electrode of the driving transistor. A gate of the fifth switching transistor is electrically connected to the light-emitting signal terminal, a first electrode of the fifth switching transistor is electrically connected to the first voltage terminal, and a second electrode of the fifth switching transistor is electrically connected to the first electrode of the driving transistor. A gate of the sixth switching transistor is electrically connected to the light-emitting signal terminal, a first electrode of the sixth switching transistor is electrically connected to the second electrode of the driving transistor, and a second electrode of the sixth switching transistor is electrically connected to the first electrode of the light-emitting device and the second terminal of the capacitor. The gate of the driving transistor is electrically connected to the first terminal of the capacitor.

In some embodiments, the gate of the third switching transistor is electrically connected to the first reset signal terminal or the second reset signal terminal. The first to sixth switching transistors and the driving transistor are all N-type thin film transistors.

In some embodiments, the gate of the third switching transistor is electrically connected to the light-emitting signal terminal. The third switching transistor is a P-type thin film transistor, and the first switching transistor, the second switching transistor, the fourth switching transistor, the fifth switching transistor, the sixth switching transistor and the driving transistor are all N-type thin film transistors.

In another aspect, a pixel driving method of the pixel driving circuit described above is provided. The pixel driving method includes a writing and compensation period and a light-emitting period within an image frame. In the writing and compensation period, the data writing sub-circuit writes the data signal to the driving sub-circuit under control of the scanning signal; and the compensation sub-circuit compensates the voltage of the driving sub-circuit under control of the scanning signal. In the light-emitting period, the light-emitting control sub-circuit turns on a line, on which the light-emitting device is located, between the first voltage terminal and the second voltage terminal under control of the light-emitting signal, and the driving sub-circuit drives the light-emitting device to emit light according to a written data signal.

In some embodiments, the pixel driving circuit further includes a first reset sub-circuit and a second reset sub-circuit, and the pixel driving method further includes a reset period within the image frame. In the reset period, the first reset sub-circuit transmits the first voltage signal to the first terminal of the driving sub-circuit under control of a first reset signal, and the second reset sub-circuit transmits an initialization voltage signal from an initialization voltage signal terminal to a third terminal of the driving sub-circuit and a first electrode of the light-emitting device under control of one of the first reset signal, the second reset signal and the light-emitting signal.

In some embodiments, if the second reset sub-circuit transmits the initialization voltage signal to the third terminal of the driving sub-circuit and the first electrode of the light-emitting device under control of the second reset signal, the pixel driving method further includes: in the writing and compensation period, the second reset sub-circuit transmitting the initialization voltage signal to the third terminal of the driving sub-circuit and the first electrode of the light-emitting device under control of the second reset signal.

In some embodiments, if the second reset sub-circuit transmits the initialization voltage signal to the third terminal of the driving sub-circuit and the first electrode of the light-emitting device under control of the light-emitting signal, the pixel driving method further includes: in the writing and compensation period, the second reset sub-circuit transmitting the initialization voltage signal to the third terminal of the driving sub-circuit and the first electrode of the light-emitting device under control of the light-emitting signal.

In yet another aspect, a display panel is provided. The display panel includes a plurality of sub-pixels, and at least one sub-pixel includes the pixel driving circuit described above and a corresponding light-emitting device.

In yet another aspect, a display apparatus is provided. The display apparatus includes the display panel described above and a display control device. The display control device includes the scanning signal terminal, the data signal terminal, the light-emitting signal terminal, the first voltage terminal, and the second voltage terminal, and is configured to provide the scanning signal, the data signal, the light-emitting signal, a first voltage signal and a second voltage signal to the display panel.

BRIEF DESCRIPTION OF THE DRAWINGS

In order to describe technical solutions in the embodiments of the present disclosure more clearly, accompanying drawings to be used in some embodiments of the present disclosure will be introduced briefly below. However, the accompanying drawings to be described below are merely accompanying drawings of some embodiments of the present disclosure, and a person of ordinary skill in the art may obtain other drawings according to these drawings. In addition, the accompanying drawings in the following description may be regarded as schematic diagrams, and are not limitations on an actual size of a product, an actual process of a method, or an actual timing of signals involved in the embodiments of the present disclosure.

Figure 8:
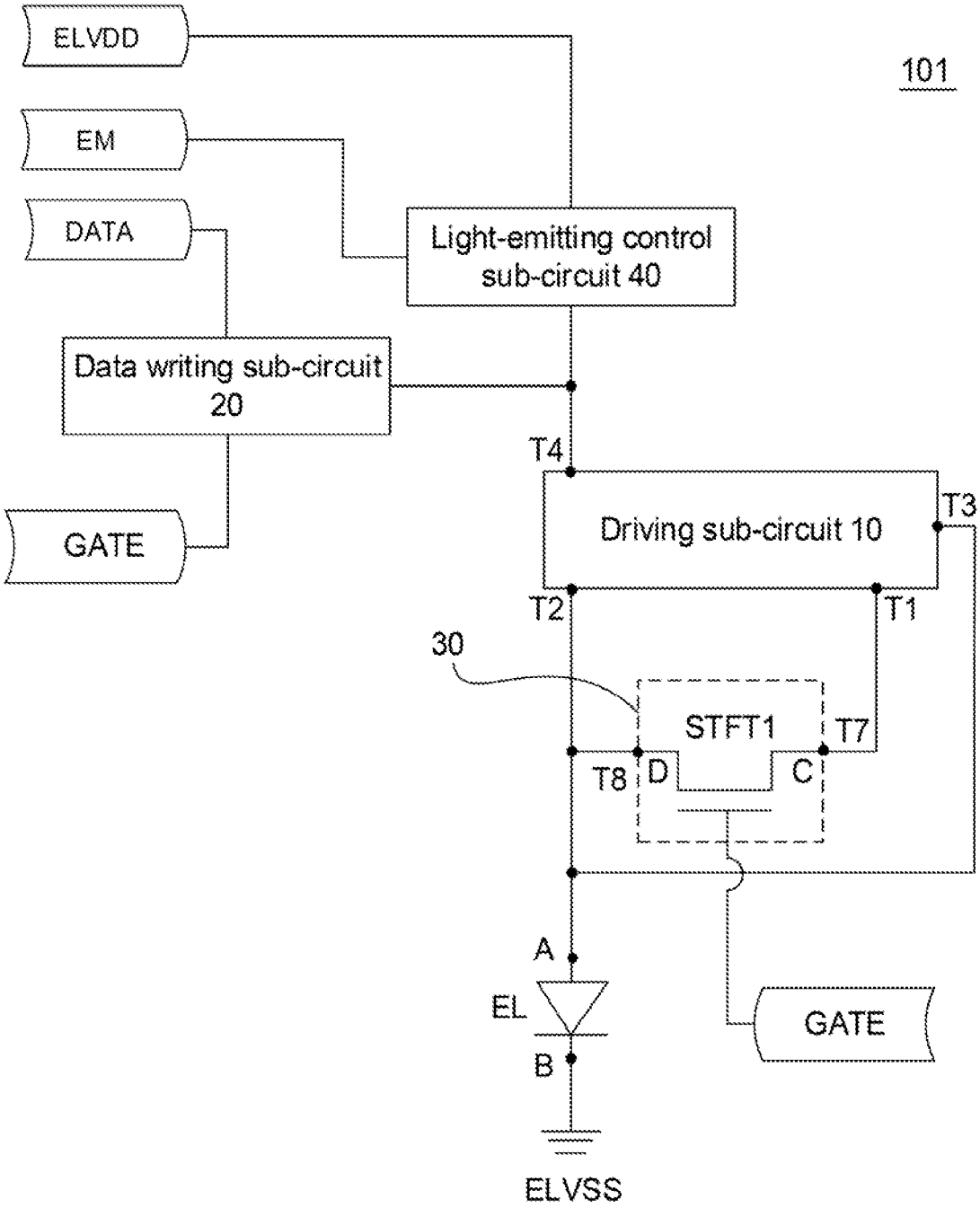
Figure 9:
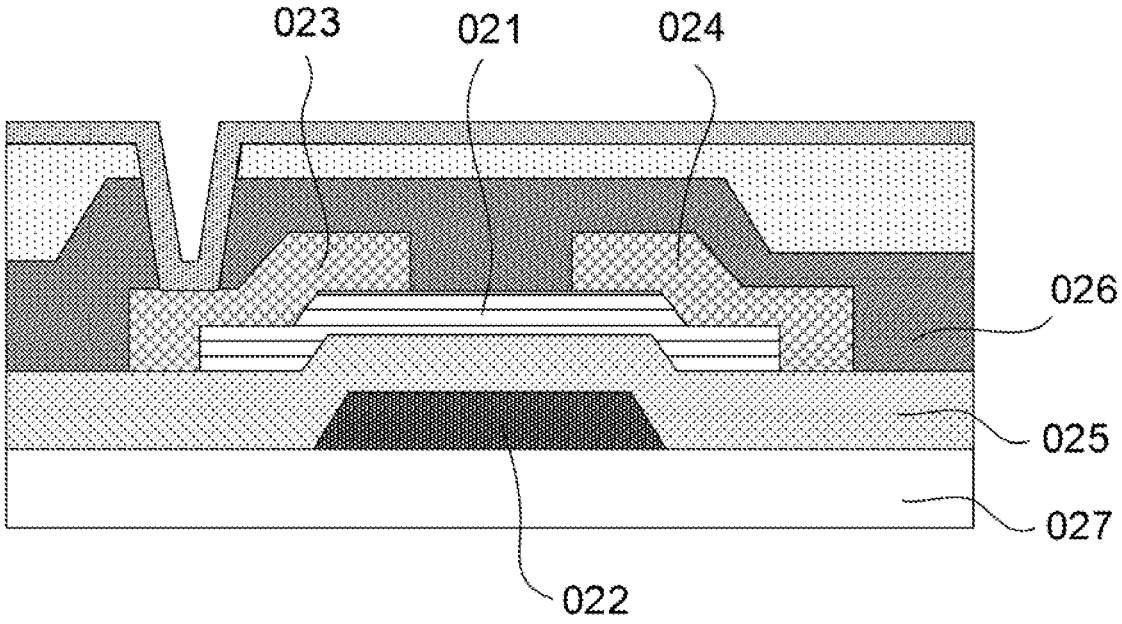
Figure 10:
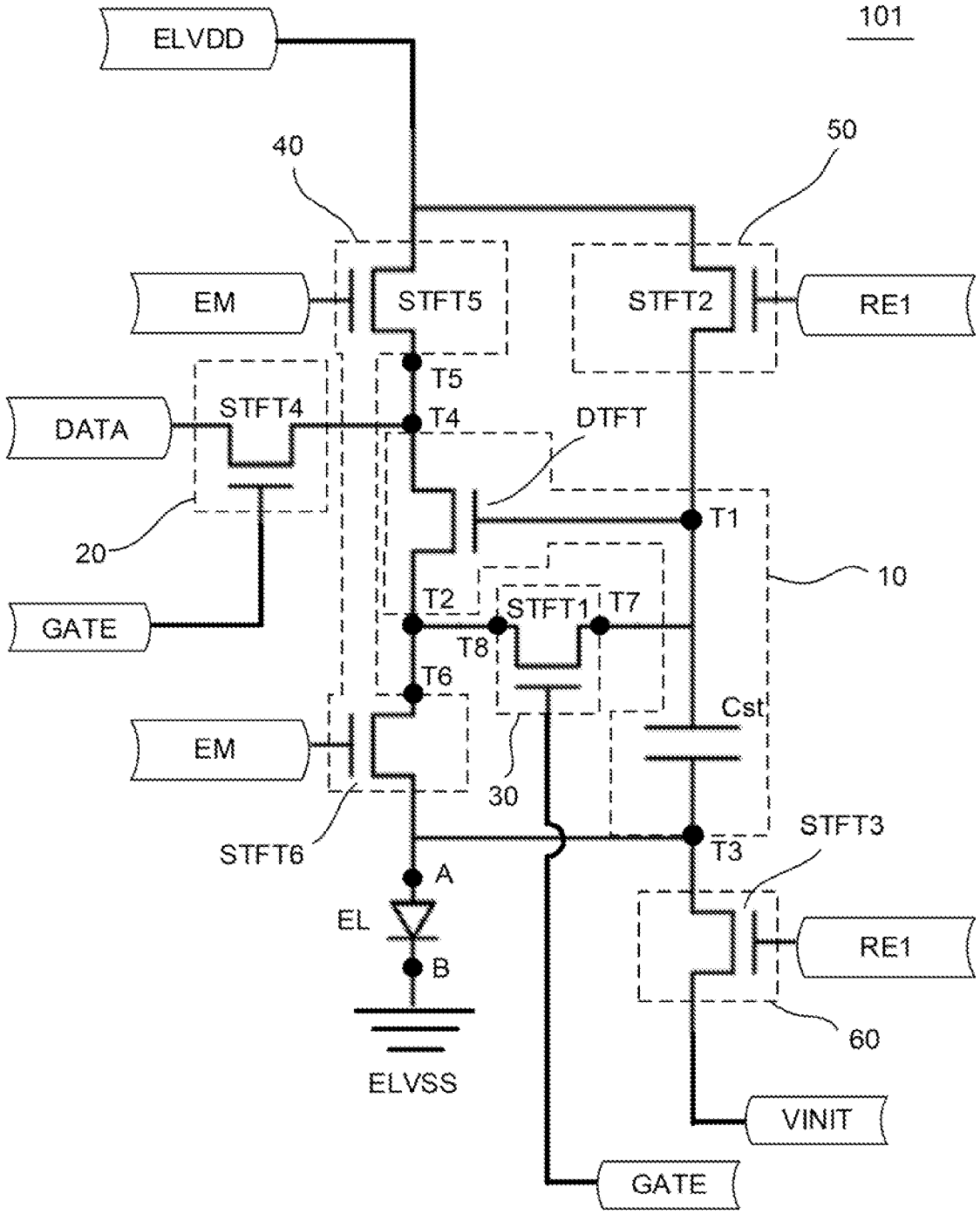
Figure 11:
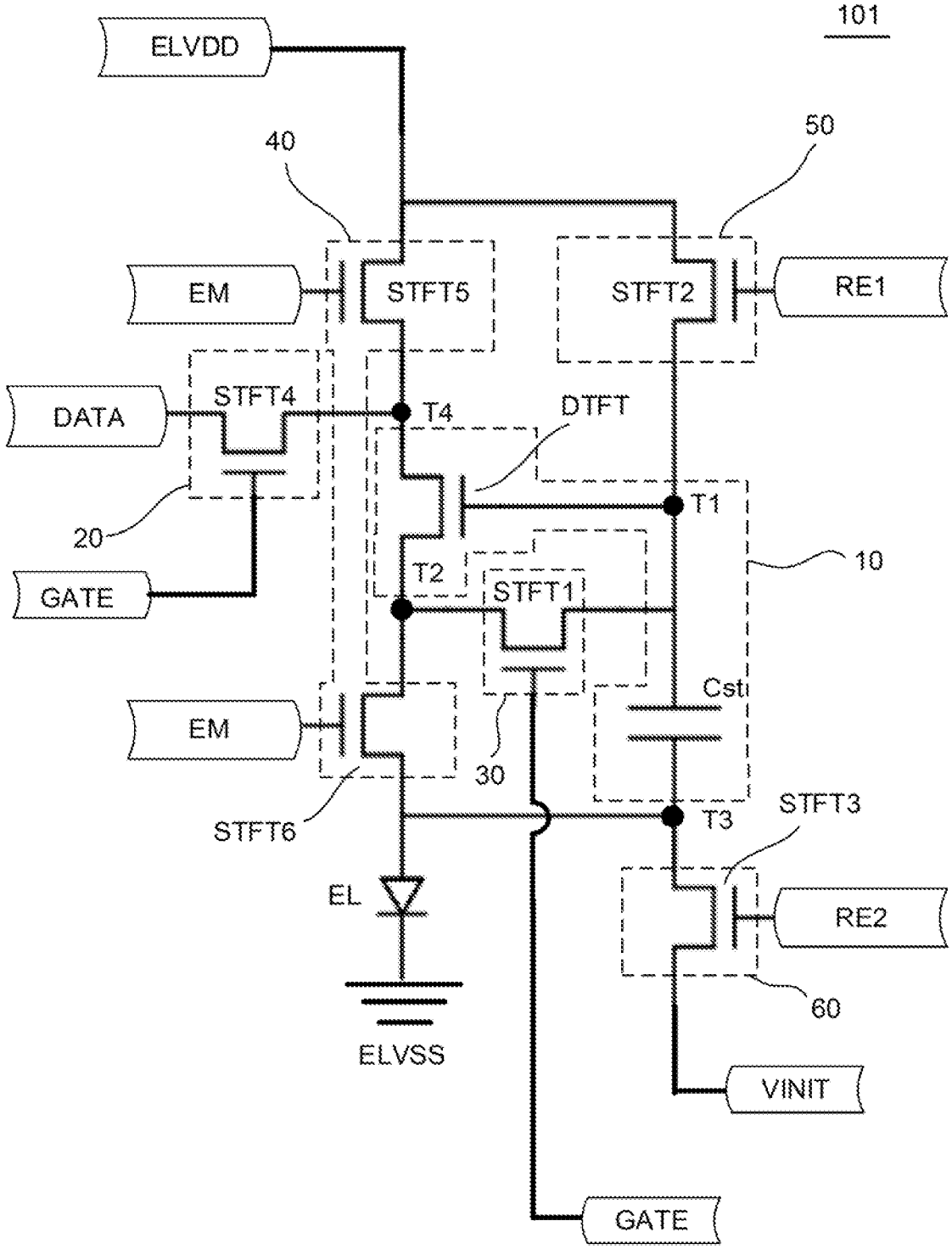
Figure 12:
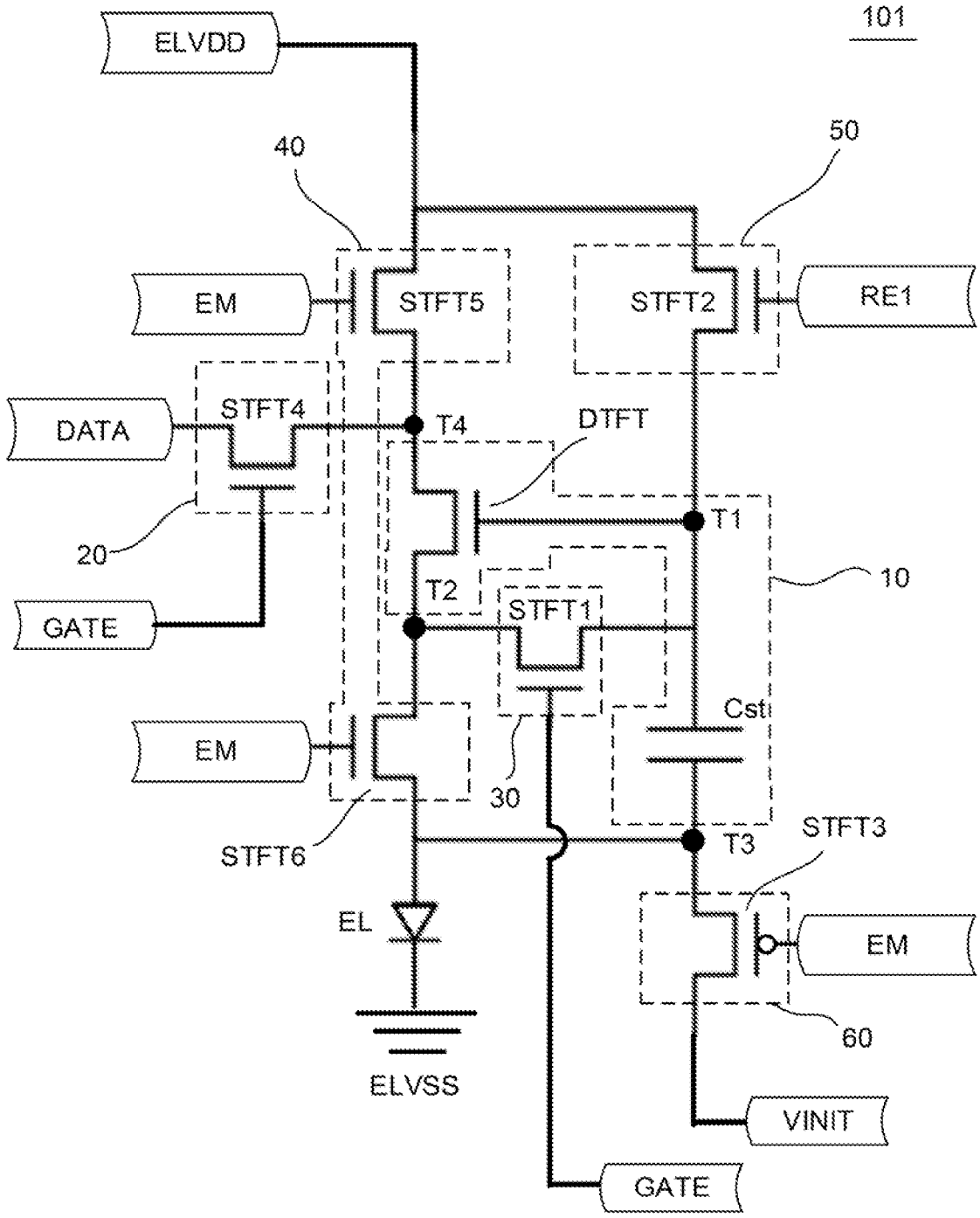
Figure 13:
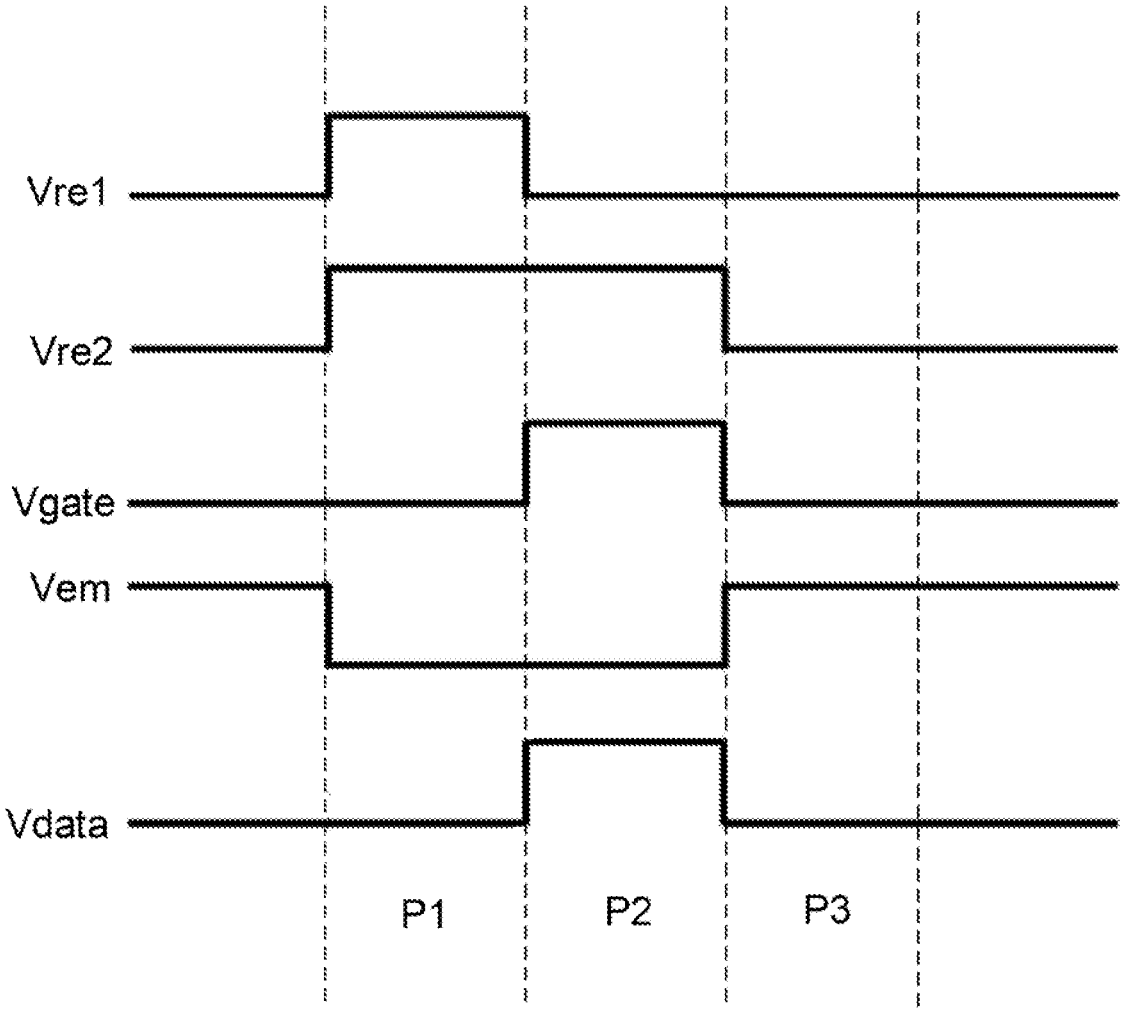
Figure 14:
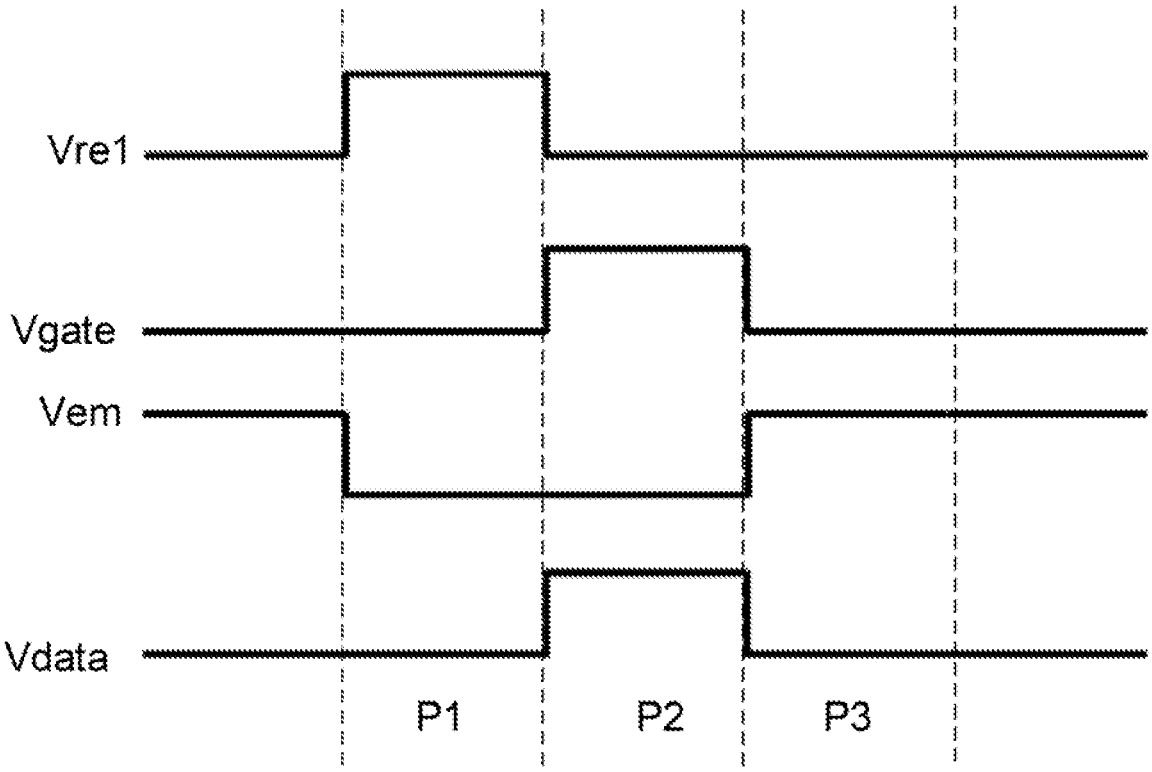
Figure 15:
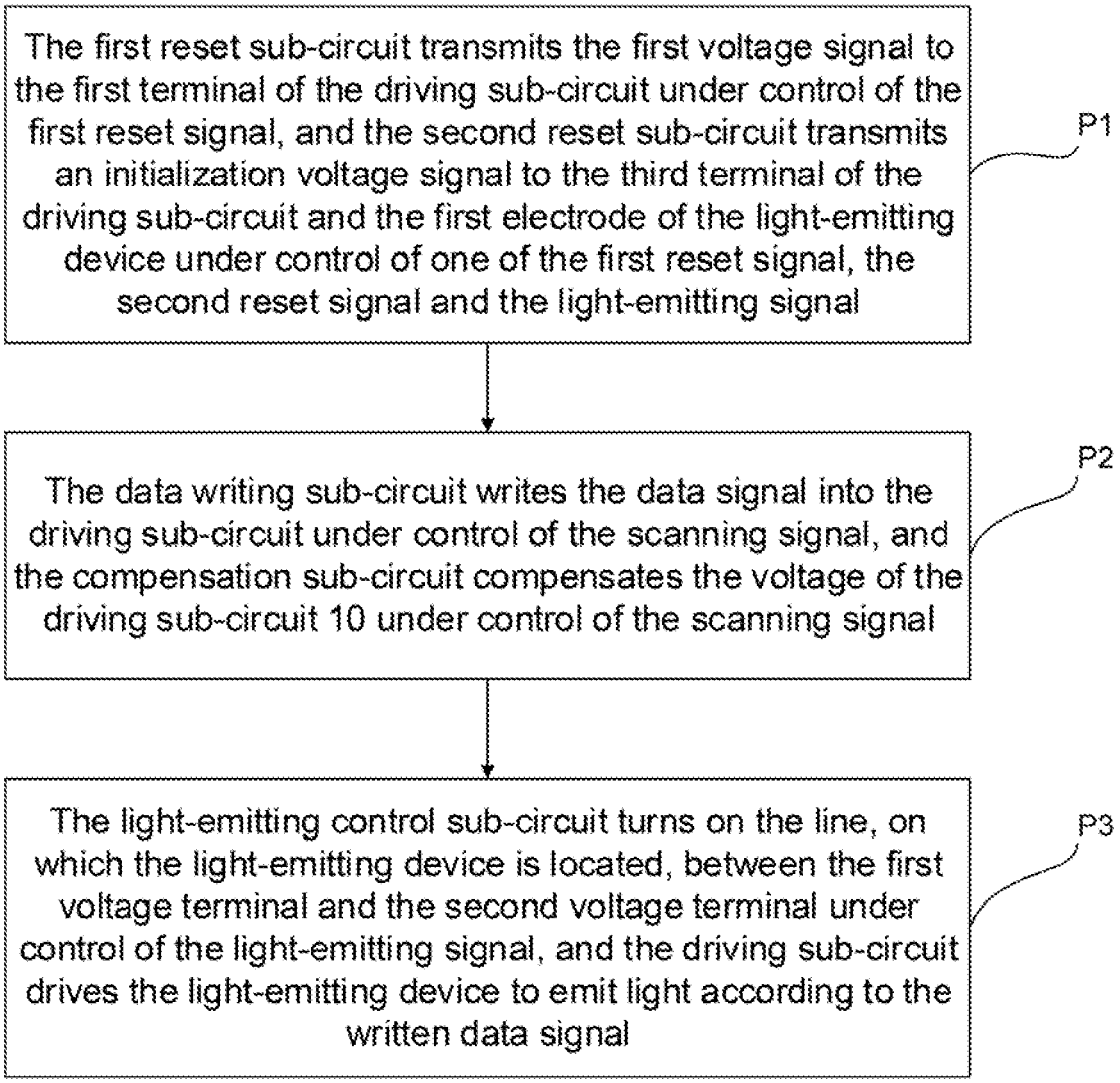
Figure 16:
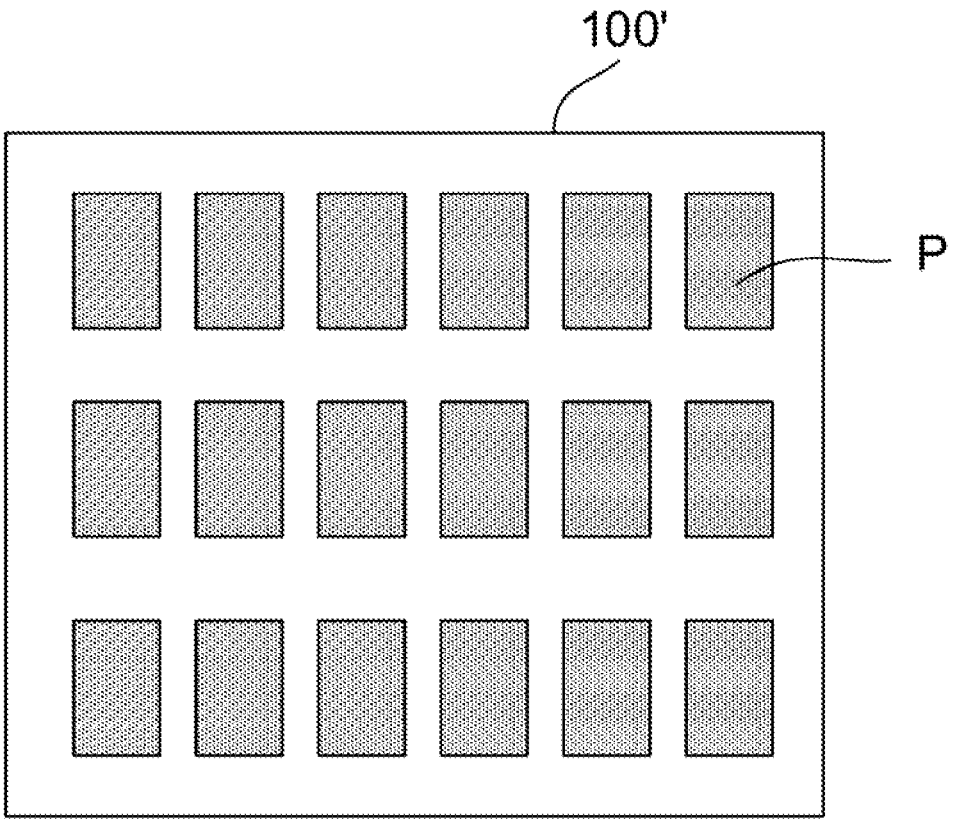

FIG. T is a schematic diagram showing a structure of a thin film transistor;

FIG. 8 is a schematic diagram of a pixel driving circuit, in accordance with some embodiments;

FIG. 9 is a schematic diagram showing a structure of a thin film transistor in a pixel driving circuit, in accordance with some embodiments:

FIG. 10 is a schematic diagram of another pixel driving circuit, in accordance with some embodiments;

FIG. 11 is a schematic diagrams of yet another pixel driving circuit, in accordance with some embodiments:

FIG. 12 is a schematic diagram of yet another pixel driving circuit, in accordance with some embodiments;

FIG. 13 is a signal diagram of a pixel driving method, in accordance with some embodiments;

FIG. 14 is a signal timing diagram of another pixel driving method, in accordance with some embodiments;

FIG. 15 is a flow chart of a pixel driving method, in accordance with some embodiments; and FIG. 16 is a schematic diagram of a display panel, in accordance with some embodiments.

DETAILED DESCRIPTION

Technical solutions in some embodiments of the present disclosure will be described clearly and completely in combination with accompanying drawings, Obviously, the described embodiments are merely some but not all embodiments of the present disclosure. All other embodiments obtained on a basis of the embodiments of the present disclosure by a person of ordinary skill in the art shall be included in the protection scope of the present disclosure.

Unless the context requires otherwise, the term "comprise" and other forms thereof such as the third-person singular form "comprises" and the present participle form "comprising" in the specification and the claims are interpreted as open and inclusive, meaning "including, but not limited to". In the description, terms such as "one embodiment", "some embodiments", "exemplary embodiments", "example", "some examples", or "specific example" are intended to indicate that specific features, structures, materials or characteristics related to the embodiment(s) or the example(s) are included in at least one embodiment or example of the present disclosure. Schematic representations of the above terms do not necessarily refer to the same embodiment(s) or example(s). In addition, the specific features, structures, materials or characteristics may be included in any one or more embodiments/examples in any suitable manner.

Below, terms such as "first" and "second" are used for descriptive purposes only, and are not to be construed as indicating or implying the relative importance or implicitly indicating the number of indicated technical features. Thus, features defined as "first" and "second" may explicitly or implicitly include one or more of the features. In the description of the embodiments of the present disclosure, "a/the plurality of" means two or more unless otherwise specified.

In the description of some embodiments, the terms "coupled", "connected" and their derivatives may be used. For example, the term "connected" may be used in the description of some embodiments to indicate that two or more components are in direct physical or electrical contact with each other. For another example, the term "coupled" may be used in the description of some embodiments to indicate that two or more components are in direct physical or electrical contact. However, terms such as "coupled" or "communicatively coupled" may also mean that two or more components are not in direct contact with each other but still cooperate or interact with each other. The embodiments disclosed herein are not necessarily limited to the content herein.

"At least one of A, B, and C" has a same meaning as "at least one of A, B, or C", and both include the following combinations of A, B, and C: only A, only B, only C, a combination of A and B, a combination of A and C, a combination of B and C, and a combination of A, B, and C.

Figure 1:
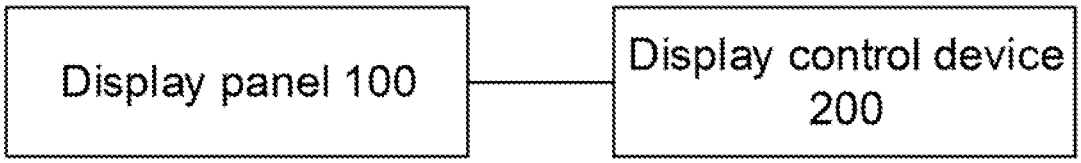
FIG. 1 is a block diagram of a display apparatus, in accordance with some embodiments.

FIG. 1 is a schematic diagram of a display apparatus. The display apparatus may be any product or component having a display function, such as a mobile phone, a tablet computer, a television, a display, a notebook computer, a digital photo frame, or a navigator. As shown in FIG. 1, the display apparatus includes a display panel 100 and a display control device 200 that are coupled. The display panel 100 is, for example, an organic light-emitting diode (OLEO) display panel, which can achieve flexible display and have characteristics of low power consumption, high color saturation, a wide viewing angle, and a small thickness.

Figure 2:
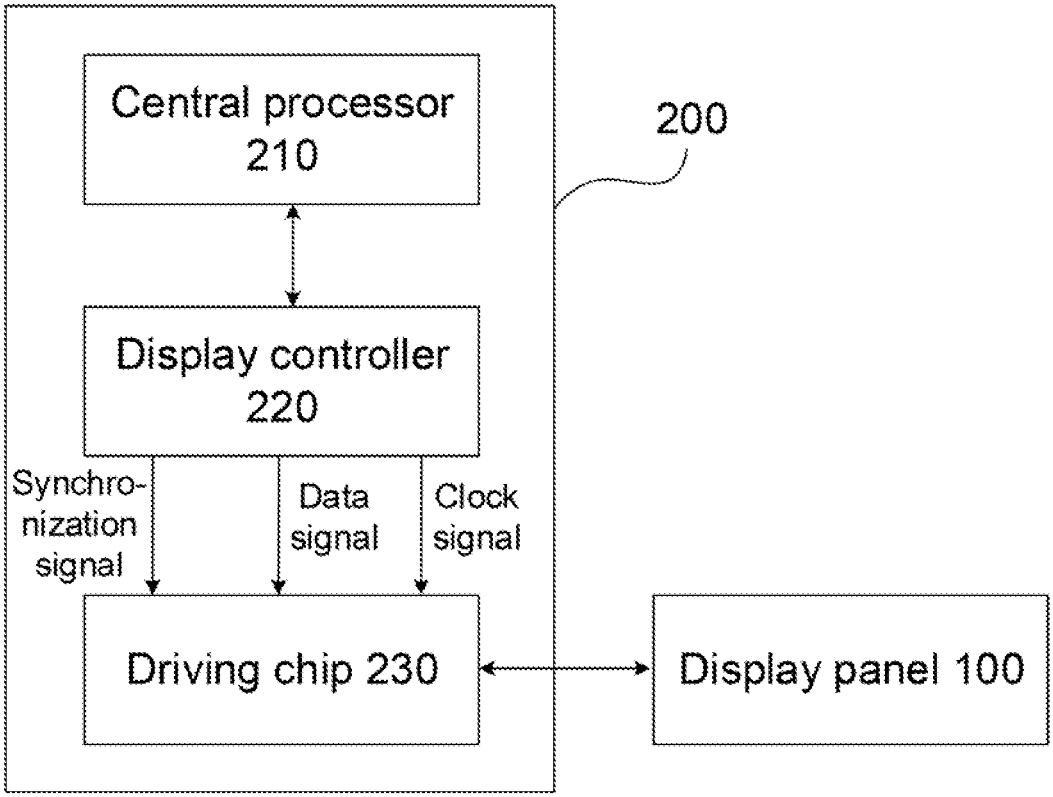
FIG. 2 is a block diagram of a display control device, in accordance with some embodiments.
Figure 3:
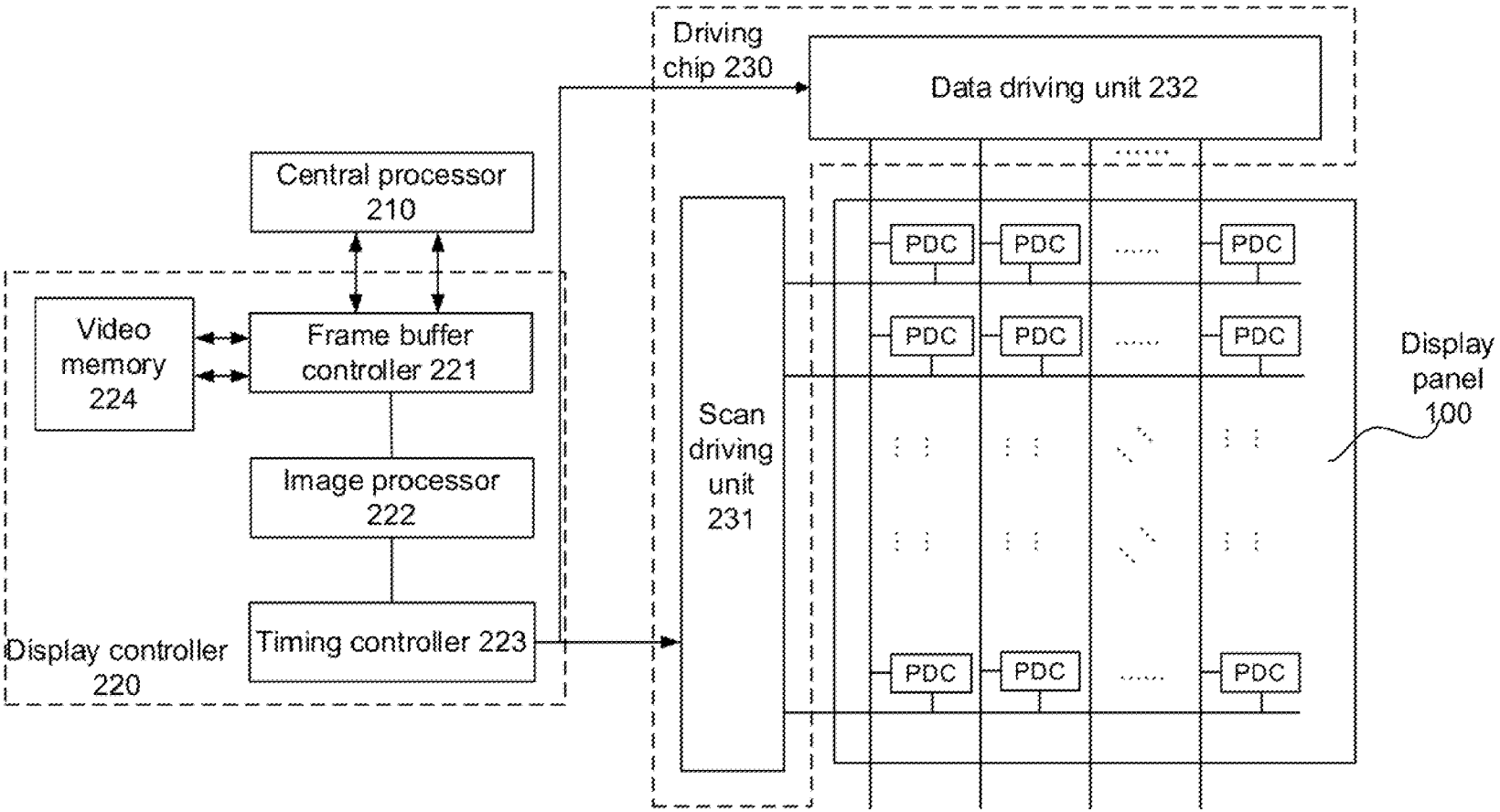
FIG. 3 is a schematic diagram of another display control device. In accordance with some embodiments.

As shown in FIG. 2, the display control device 200 includes a central processor 210, a display controller 220 and a driving chip 230. As shown in FIG. 3, the display controller 220 includes a frame buffer controller 221, an image processor 222, a timing controller 223, and a video memory 224. The driving chip 230 includes a scan driving unit 231 and a data driving unit 232. The central processor 210 is coupled to the frame buffer controller 221. The frame buffer controller 221 is further coupled to the video memory 224 and the image processor 222. The image processor 222 is further coupled to the timing controller 223, and the timing controller 223 is further coupled to the scan driving unit 231 through a scan control circuit, and coupled to the data driving unit 232 through a data control circuit.

As shown in FIGS. 3 and 8, the scan driving unit 231 may include a scanning signal terminal GATE, and the data driving unit 232 may include a data signal terminal DATA. In addition, the scan driving unit 231 is configured to provide a scanning signal Vgate to the display panel 100 through the scanning signal terminal GATE, and the data driving unit 232 is configured to provide a data signal Vdata to the display panel 100 through the data signal terminal DATA. In addition, the display panel 10 may receive any one of a light-emitting signal Vem from a light-emitting signal terminal EM, a first voltage signal Vdd from a first voltage terminal ELVDD, and a second voltage signal Vss from a second voltage terminal ELVSS.

It will be understood that conventional timing controllers are only used to generate timing control signals, and are not able to process data signals (which are used to make each sub-pixel in the display apparatus to have its own gray scale value, so as to realize image display). However, with the development of display technology, timing controllers can have an image processing function, which enables the timing controllers to process data signals. For example, the timing controller 223 may be a timing controller having the image processing function.

Of course, at least one part of the driving chip 230 may be integrated in the display panel 100. For example, the driving chip 230 is disposed on the display panel 100, and the remaining components, such as the central processor 210 and the display controller 220, of the display control device 200 are not disposed on the display panel 100. That is, a chip on glass (COG) design is adopted. For another example, the scan driving unit 231 is disposed on the display panel 100. That is, a gate on array (GOA) design is adopted.

As shown in FIG. 3, in an example where the display panel 100 is an OLED display panel, the OLED display panel may be manufactured through a film forming process and an etching process. For example, the film forming process may include or may be a magnetron sputtering process or a vacuum evaporation process. The etching process may include or may be a wet etching process or a dry etching process.

Figure 4:
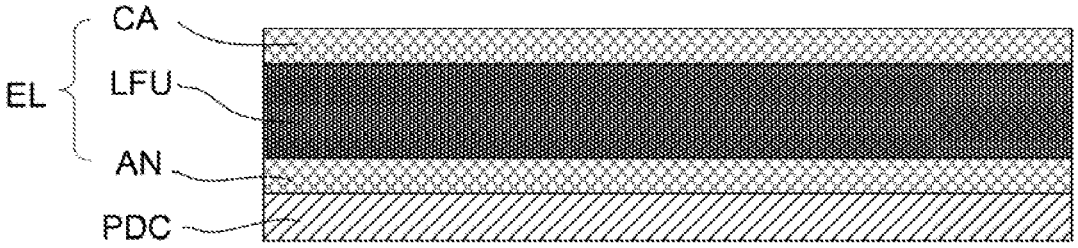
FIG. 4 is a schematic diagram showing a structure of light-emitting device, in accordance with some embodiments.

The display panel 100 may include a display driving circuit layer and a light-emitting device layer that are stacked. As shown in FIGS. 3 and 4, the display driving circuit layer includes a plurality of pixel driving circuits PDC arranged in an array, and the light-emitting device layer includes a plurality of light-emitting devices EL arranged in an array. Herein, the plurality of pixel driving circuits PDC are electrically connected to the plurality of light-emitting devices EL in one-to-one correspondence. The plurality of pixel driving circuits PDC are further electrically connected to the scan driving unit 231 and the data driving unit 232. In addition, the plurality of pixel driving circuits PDC are electrically connected to wires in the display panel, such as power lines, which are used to provide the first voltage signal Vdd and the second voltage signal Vss.

Figure 5:
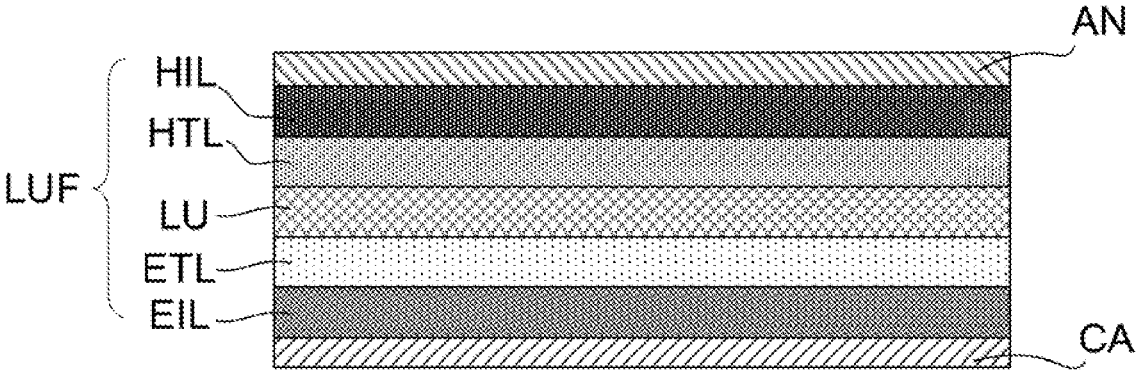
FIG. 5 is a schematic diagram showing a structure of a light-emitting functional layer in a light-emitting device, in accordance with some embodiments.

In some examples, the display panel 100 includes a plurality of sub-pixels, and each pixel includes a pixel driving circuit PDC and a light-emitting device EL. As shown in FIG. 4, the light-emitting device EL has a laminated structure similar to a sandwich. The light-emitting device EL with the laminated structure includes a cathode CA, an anode AN, and a light-emitting functional layer LFU located between the anode AN and the cathode CA. For example, as shown in FIG. 5, the light-emitting functional layer LFU includes an electron injection layer EIL, an electron transport layer ETL, a light-emitting layer LU, a hole transport layer HTL, and a hole injection layer HIL, all of which are stacked sequentially.

A light-emitting process of the light-emitting device EL will be exemplarily described below by taking the structure shown in FIGS. 4 and 5 as an example. Electron holes are injected from the anode layer AN into the hole injection layer HIL through an applied voltage, and reach the light-emitting layer LU through the hole transport layer HTL. At a same time, electrons are injected from the cathode layer CA into the electron injection layer EIL through the applied voltage, and reach the light-emitting layer LU through the electron transport layer ETL. The electrons and electron holes are recombined into excitons in the light-emitting layer LU, and the excitons may release their energy to create photons, thereby making the light-emitting device EL emit light.

The pixel driving circuit PDC shown in FIG. 3 may be a 2T1C pixel driving circuit or a 3T1C pixel driving circuit. Of course, the pixel driving circuit is not limited thereto, and may have other structures.

Figure 6:
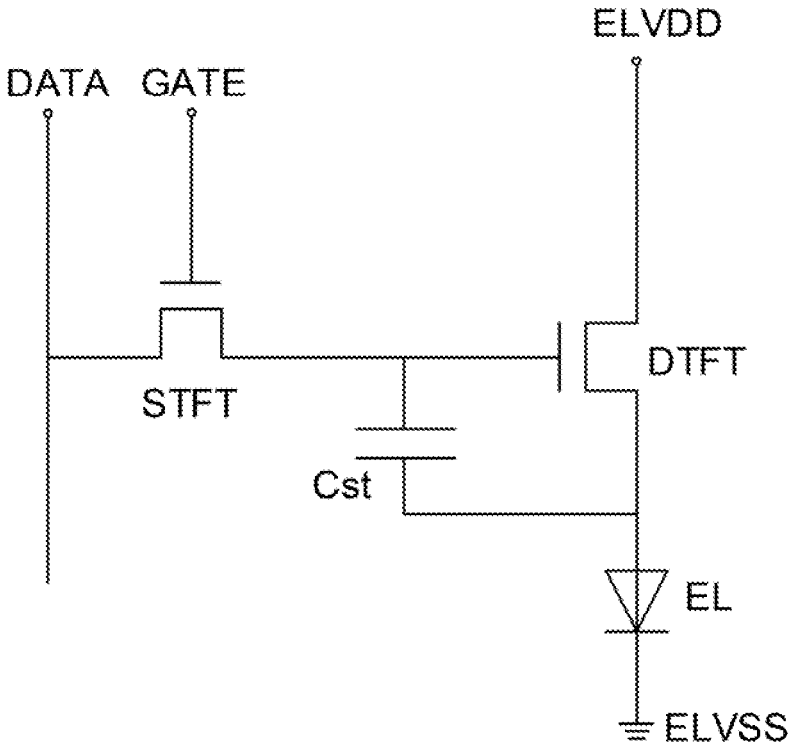
FIG. 6 is a schematic diagram of a 2T1C pixel driving circuit.

For example, referring to FIG. 6, the pixel driving circuit PDC is the 2T1C pixel driving circuit, and the pixel driving circuit includes a capacitor Cst, a switching transistor STFT and a driving transistor DTFT used for driving the light-emitting device EL to emit light. In this pixel driving circuit PDC, the switching transistor STFT is controlled to be turned on or off by a gate signal from the scanning signal terminal GATE. When being in a turned-on state, the switching transistor STFT transmits a data signal from the data signal terminal DATA to the capacitor Cst, and thus a voltage of the data signal is written into the capacitor Cst. In this way, the capacitor Cst may be able to control the driving transistor DTFT to be kept in the turned-on state, so that a line, on which the light-emitting device EL is located, between the first voltage terminal ELVDD and the second voltage terminal ELVSS is turned on. In this case, the light-emitting device EL, which is electrically connected to the second voltage terminal ELVSS through its cathode, is driven to emit light.

Figure 7:
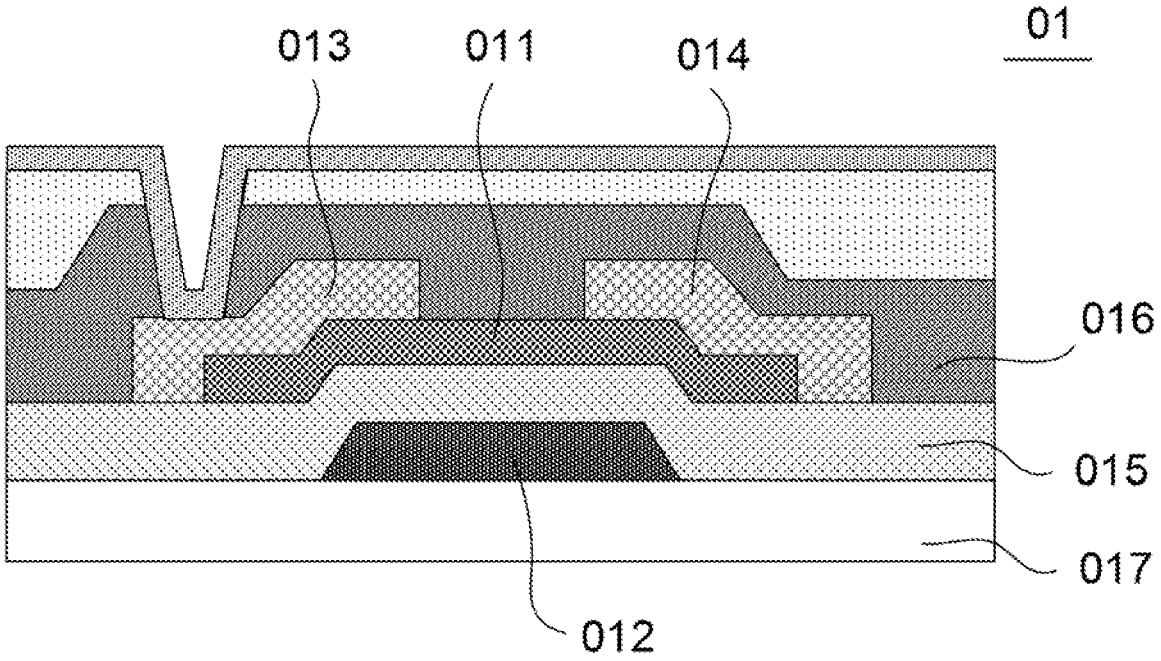

The switching transistor STFT and driving transistor DTFT may be amorphous silicon thin film transistors. For example, as shown in FIG. 7, the thin film transistor 01 has a bottom-gate structure. In this case, the thin film transistor 01 includes an active layer 011, a gate 012, a source 013 and a drain 014. A material of the active layer 011 is amorphous silicon. The gate 012 is disposed on the substrate 017, the active layer 011 is disposed at a side of the gate 012 away from the substrate 017, and a first insulating layer 015 is provided between the active layer 011 and the gate 012. The source 013 and the drain 014 are disposed on a surface of the active layer 011 facing away from the substrate 017, and are in contact with the active layer 011. A second insulating layer 016 is provided on surfaces of the source 013 and the drain 014 facing away from the substrate 017. A gate voltage Vg is applied to the gate 012 to form a conductive channel in the active layer 011. In this way, a conductive path is formed between the source 013 and the drain 014, and thus the thin film transistor 01 is turned on. Of course, the thin film transistor 01 may also has a top-gate structure, which can be referred to related technologies.

Herein, the thin film transistor 01 may be an N-type thin film transistor or a P-type thin film transistor, and their difference lies in that the type of the active layer 011 is different. The N-type thin film transistor and the P-type thin film transistor are turned on under different conditions. For example, the N-type thin film transistor is turned on under control of a high-level signal, and turned off under control of a low-level signal. The P-type thin film transistor is turned on under control of a low-level signal, and turned off under control of a high-level signal.

It will be noted that during a display process of the display apparatus, the thin film transistor 01 in the pixel driving circuit PDC may have a leakage problem when being used as the switching transistor STFT in the pixel driving circuit PDC. For example, when the switching transistor STFT is the N-type thin film transistor, and the gate voltage Vg applied to the gate is at a low level, there may still be a current flowing between the source 3 and the drain 4. As a result, a gate-source voltage Vgs across the gate (which is electrically connected to the switching transistor SIFT) and the source (which is electrically connected to the light-emitting device L) of the driving transistor DTFT will fluctuate. It will be known from the driving current formula $I=K(Vgs-Vth)^2$ that a brightness of the light-emitting device EL is related to the gate-source voltage Vgs of the driving transistor DTFT. That is, when the gate-source voltage Vgs of the driving transistor DTFT fluctuates, the brightness of the light-emitting device EL will also change, which may affect a display effect of the display apparatus.

With regard to this problem, as shown in FIG. 8, some embodiments of the present disclosure provide a pixel driving circuit 101. The pixel driving circuit 101 includes a driving sub-circuit 10, a data writing sub-circuit 20, a compensation sub-circuit 30, and a light-emitting control sub-circuit 40.

The driving sub-circuit 10 is configured to drive the light-emitting device EL to emit light.

The data writing sub-circuit 20 is electrically connected to the driving sub-circuit 10, and is configured to write a data signal Vdata from the data signal terminal DATA to the driving sub-circuit 10 in response to a scanning signal Vgate from a scanning signal terminal GATE.

The compensation sub-circuit 30 is electrically connected to the driving sub-circuit 10, and is configured to compensate a voltage of the driving sub-circuit 10 in response to the scanning signal Vgate.

The compensation sub-circuit 30 includes, for example, a first switching transistor STFT1. A gate of the first switching transistor STFT1 is electrically connected to the scanning signal terminal GATE, a first electrode C of the first switching transistor STFT1 is electrically connected to a first terminal T1 of the driving sub-circuit 10, and a second electrode D of the first switching transistor STFT1 is electrically connected to a second terminal T2 of the driving sub-circuit 10, The first switching transistor STFT1 is an oxide thin film transistor.

The light-emitting control sub-circuit 40 is electrically connected to the driving sub-circuit 10, and is configured to turn on a line, on which the light-emitting device EL is located, between the first voltage terminal ELVDD and the second voltage terminal ELVSS in response to a light-emitting signal Vem from a light-emitting signal terminal EM, so as to allow the driving sub-circuit 10 to drive the light-emitting device EL to emit light.

For example, the first switching transistor STFT1, as shown in FIG. 9, includes a gate 022, an active layer 021, a first electrode 023 and a second electrode 024. A material of the active layer 021 is oxide, such as metal oxide. The gate 022 is disposed on the substrate 027, the active layer 021 is disposed at a side of the gate 022 away from the substrate 027, and a first insulating layer 025 is provided between the active layer 021 and the gate 022. The source 023 and the drain 024 are disposed on a surface of the active layer 021 facing away from the substrate 027, and are in contact with the active layer 021. A second insulating layer 026 is provided on surfaces of the source 023 and the drain 024 facing away from the substrate 027.

It will be noted that before the light-emitting device EL is driven to emit light, the compensation sub-circuit 30 has completed voltage compensation of the driving sub-circuit 20. During a light-emitting process of the light-emitting device EL, the first switching transistor STFT1 is turned off under control of the scanning signal Vgate. Compared with an amorphous silicon thin film transistor in a turned-off state, the oxide thin film transistor in the turned-off state has a smaller leakage current. That is, the first switching transistor STFT1 in the turned-off state has a smaller leakage current. Therefore, the leakage current flowing through the first switching transistor STFT1 may have a smaller impact on voltages at the first terminal T1 and the second terminal T2 of the driving sub-circuit 10, and an operating state of the driving sub-circuit 10 may be more stable. In this way, there is a small fluctuation in the driving current provided by the driving sub-circuit 10 to the light-emitting device EL. As a result, a stability of the brightness of the light-emitting device EL may be improved, and the display effect of the display apparatus may be improved.

In addition, oxide thin film transistors have a high electron mobility rate. For example, a mobility rate of carriers of indium gallium zinc oxide (IGZO) thin film transistors is approximately 20 to 30 times that of amorphous silicon thin film transistors. Therefore, a writing rate of the data signal Vdata and a voltage compensation rate of the driving sub-circuit 10 may be increased, and a refresh rate of the display apparatus may be increased.

In some embodiments, the first switching transistor STFT1 is an IGZO (Indium Gallium Zinc Oxide) thin film transistor.

In some embodiments, referring to FIGS. 10 to 12, the pixel driving circuit 101 further includes a first reset sub-circuit 50. The first reset sub-circuit 50 is electrically connected to the driving sub-circuit 10. The first reset sub-circuit 50 is configured to transmit a first voltage signal Vdd from the first voltage terminal ELVDD to the first terminal T1 of the driving sub-circuit 10 in response to a first reset signal Vial from a first reset signal terminal RE1.

In this way, the first reset sub-circuit 50 may be able to reset a voltage at the first terminal T1 of the driving sub-circuit 10, so that an impact of the data signal Vdata written into the driving sub-circuit 10 in a previous image frame on the data signal Vdata written into the driving sub-circuit 20 in a current image frame may be decreased, and a stability of image display may be improved.

In some examples, with continued reference to FIGS. 10 to 12, the first reset sub-circuit 50 includes a second switching transistor STFT2. A gate of the second switching transistor STFT2 is electrically connected to the first reset signal terminal RE1, a first electrode of the second switching transistor STFT2 is electrically connected to the first voltage terminal ELVDD, and a second electrode of the second switching transistor STFT2 is electrically connected to the first terminal T1 of the driving sub-circuit 10.

The second switching transistor STFT2 may be an oxide thin film transistor. For example, the second switching transistor STFT2 is an IGZO thin film transistor.

As for a structure of the second switching transistor STFT2, reference may be made to the first switching transistor STFT1 shown in FIG. 9, and details will not be repeated here.

It will be noted that, before the light-emitting device EL is driven to emit light, the first reset sub-circuit 50 has finished resetting the voltage at the first terminal T1 of the driving sub-circuit 10. During the light-emitting process of the light-emitting device EL, the second switching transistor STFT2 is turned off under control of the first reset signal Vre1. Compared with an amorphous silicon thin film transistor in the turned-off state, the second switching transistor STFT2, which is the oxide thin film transistor, in the turned-off state has a smaller leakage current. Therefore, the leakage current flowing through the second switching transistor STFT2 may have a smaller impact on the voltage at the first terminal T1 of the driving sub-circuit 10, and the operating state of the driving sub-circuit 10 may be more stable. As a result, the stability of the brightness of the light-emitting device EL may be further improved.

It will be noted that FIGS. 10 to 12 are illustrations by taking an example in which the first electrode A of the light-emitting device EL is an anode, and the second electrode B of the light-emitting device EL is a cathode. In this case, the second electrode B of the light-emitting device EL is electrically connected to the second voltage terminal ELVSS. Herein, the second voltage signal Vss from the second voltage terminal ELVSS is a low-level signal, and the first voltage signal Vdd is a high-level signal. In some other embodiments, the first electrode A of the light-emitting device EL is a cathode, the second electrode B of the light-emitting device EL is an anode, the second voltage signal Vss is a high-level signal, and the first voltage signal Vdd is a low-level signal. In this case, the structure of the pixel driving circuit may be set according to an actual need.

With continued reference to FIGS. 10 to 12, in some embodiments, the pixel driving circuit 101 further includes a second reset sub-circuit 60. The second reset sub-circuit 60 is electrically connected to the driving sub-circuit 10.

In some examples, referring to FIG. 10, the second reset sub-circuit 60 is configured to transmit an initialization voltage signal Vinit from an initialization voltage signal terminal VINIT to a third terminal T3 of the driving sub-circuit 10 and the first electrode A of the light-emitting device EL in response to the first reset signal Vre1, so as to reset voltages at the third terminal T3 of the driving sub-circuit 10 and the first electrode A of the light-emitting device EL. In this way, an impact of the data signal Vdata written into the driving sub-circuit 10 in the previous image frame on the data signal Vdata written into the driving sub-circuit 20 in the current image frame may be decreased. In addition, it may be possible to reduce the number of carriers that do not recombine in a light-emitting layer inside the light-emitting device EL, and slow the aging of the light-emitting device EL.

In this case, for example, the second reset sub-circuit 60 includes a third switching transistor STFT3. A gate of the third switching transistor STFT3 is electrically connected to the first reset signal terminal RE1, a first electrode of the third switching transistor SIFT is electrically connected to the initialization voltage signal terminal VINIT and a second electrode of the third switching transistor SIFT is electrically connected to the third terminal T3 of the driving sub-circuit 10.

In some other examples, referring to FIG. 11, the second reset sub-circuit 60 is configured to transmit the initialization voltage signal Vinit from the initialization voltage signal terminal VINIT to the third terminal T3 of the driving sub-circuit 10 and the first electrode A of the light-emitting device in response to a second reset signal Vre2 from a second reset signal terminal RE2, so as to reset the voltages at the third terminal T3 of the driving sub-circuit 10 and the first electrode A of the light-emitting device EL.

In this case, for example, the second reset sub-circuit 60 includes the third switching transistor STFT3. The gate of the third switching transistor STFT3 is electrically connected to the second reset signal terminal RE2, the first electrode of the third switching transistor STFT3 is electrically connected to the initialization voltage signal terminal VINIT and the second electrode of the third switching transistor STFT3 is electrically connected to the third terminal T3 of the driving sub-circuit 10.

In some other examples, referring to FIG. 12, the second reset sub-circuit 60 is configured to transmit the initialization voltage signal Vinit from the initialization voltage signal terminal VINIT to the third terminal T3 of the driving sub-circuit and the first electrode A of the light-emitting device EL in response to the light-emitting signal Vem, so as to reset the voltages at the third terminal T3 of the driving sub-circuit 10 and the first electrode A of the light-emitting device EL.

In this case, for example, the second reset sub-circuit 60 includes the third switching transistor STFT3. The gate of the third switching transistor STFT3 is electrically connected to the light-emitting signal terminal EM, the first electrode of the third switching transistor STFT3 is electrically connected to the initialization voltage signal terminal VINIT and the second electrode of the third switching transistor STFT3 is electrically connected to the third terminal T3 of the driving sub-circuit 10.

The data writing sub-circuit 20, the driving sub-circuit 10 and the light-emitting control sub-circuit 40 of the pixel driving circuit 101 will be described below by taking an example in which the structure of the pixel driving circuit 101 is shown in FIG. 10.

In some embodiments, the data writing sub-circuit 20 includes a fourth switching transistor STFT4. A gate of the fourth switching transistor STFT4 is electrically connected to the scanning signal terminal GATE, a first electrode of the fourth switching transistor STFT4 is electrically connected to the data signal terminal DATA, and a second electrode of the fourth switching transistor STFT4 is electrically connected to a fourth terminal T4 of the driving sub-circuit 10.

In some embodiments, the driving sub-circuit 10 includes a driving transistor DTFT and a capacitor Cst. A gate of the driving transistor DTFT is electrically connected to a first terminal of the capacitor Cat and the first reset sub-circuit 50, a first electrode of the driving transistor DTFT is electrically connected to the data writing sub-circuit 20 and a first terminal T5 of the light-emitting control sub-circuit 40, and a second electrode of the driving transistor DTFT is electrically connected to a second terminal T6 of the light-emitting control sub-circuit 40 and a second terminal T8 of the compensation sub-circuit 30.

The first terminal of the capacitor Cst is electrically connected to a first terminal T7 of the compensation sub-circuit 30, and a second terminal of the capacitor Cat is electrically connected to the first electrode A of the light-emitting device EL and the second reset sub-circuit 60.

In this case, the second electrode of the driving transistor DTFT is electrically connected to the second electrode D of the first switching transistor STFT1 in the compensation sub-circuit 30, and a threshold voltage Vth of the driving transistor DTFT may be added to a voltage on the first terminal of the capacitor Cat by the compensation sub-circuit 30, so as to implement the compensation of the voltage of the driving sub-circuit 10.

It will be noted that a value of a driving current of the light-emitting device EL is related to a gate-source voltage Vgs of the driving transistor DTFT, and the gate-source voltage Vgs is a difference between the gate voltage Vg at the gate and the source voltage Vs at the source of the driving transistor DTFT.

In an example where the first voltage signal Vdd is a high-level signal and the second voltage signal Vss is a low-level signal, in the pixel driving circuit 101, when the light-emitting device EL is emitting light, the first switching transistor STFT1 is in a turned-off state. Since the first switching transistor STFT1 is an oxide thin film transistor, a leakage current flowing through the first switching transistor STFT1 from the first terminal of the capacitor Cst to the second voltage terminal ELVSS is small. Therefore, the leakage current has a relatively small impact on a voltage at the first terminal of the capacitor Cst. In this way, a stability of the gate voltage Vg of the driving transistor DTFT may be improved.

Similarly, when the light emitting device EL is emitting light, the second switching transistor STFT2 is in a turned-off state. Since the second switching transistor STFT2 is an oxide thin film transistor, a leakage current flowing from the first voltage terminal ELVDD to the first terminal of the capacitor Cst is small. Therefore, the leakage current has a relatively small impact on the voltage at the first terminal of the capacitor Cst. In this way, the stability of the gate voltage Vg of the driving transistor DTFT may be improved.

In some embodiments, the light-emitting control sub-circuit 40 includes a fifth switching transistor STFT5 and a sixth switching transistor STFT6. A gate of the fifth switching transistor STFT5 is electrically connected to the light-emitting signal terminal EM, a first electrode of the fifth switching transistor STFT5 is electrically connected to the first voltage terminal ELVDD, and a second electrode of the fifth switching transistor STFT5 is electrically connected to a fourth terminal T4 of the driving sub-circuit 10.

A gate of the sixth switching transistor STFT6 is electrically connected to the light-emitting signal terminal EM, a first electrode of the sixth switching transistor STFT6 is electrically connected to the second terminal T2 of the driving sub-circuit 10, and a second electrode of the sixth switching transistor STFT6 is electrically connected to the first electrode A of the light-emitting device EL.

It will be noted that, when the light-emitting device EL is emitting light, the fifth switching transistor STFT5 and the sixth switching transistor STFT6 are turned on under the control of the light-emitting signal Vera. In a case where the fifth switching transistor STFT5 and the sixth switching transistor STFT6 are not oxide thin film transistors (for example, the fifth switching transistor STFT5 and the sixth switching transistor STFT6 are amorphous silicon thin film transistors), since the two transistors are turned on, there is almost no case where the leakage current of the two transistors affects the gate voltage Vg or source voltage Vs of the driving transistor DTFT. Therefore, the fifth switching transistor STFT5 and the sixth switching transistor STFT6 may be oxide thin film transistors (such as indium gallium zinc oxide thin film transistors), amorphous silicon thin film transistors or other thin film transistors.

On this Basis, in some embodiments, referring to FIG. 12, in a case where the gate of the third switching transistor STFT3 is electrically connected to the light-emitting signal terminal EM (that is, in a case where the third switching transistor STFT3 is turned on or off under the control of the light-emitting signal Vem), the third switching transistor STFT3 is a different type of transistor from the fifth switching transistor STFT5 and the sixth switching transistor STFT6. Herein, the transistors have two types, i.e., P-type thin film transistors and N-type thin film transistors. That is to say, the third switching transistor STFT3 is one of a P-type thin film transistor and an N-type thin film transistor, and each of the fifth switching transistor and the sixth switching transistor is another of the P-type thin film transistor and the N-type thin film transistor.

For example, with continued referring to FIG. 12, the third switching transistor STFT3 is the P-type thin film transistor, and the first switching transistor STFT1 to the sixth switching transistor STFT6 and the driving transistor DTFT are all N-type thin film transistors.

It will be noted that there is no overlap between a working time of the second reset sub-circuit 60 (i.e., a time in which the second reset sub-circuit 60 resets the driving sub-circuit 10 and the light-emitting device EL) and a working time of the light-emitting control sub-circuit 40 (i.e., a time in which the light-emitting control sub-circuit 40 turns on the line between the first voltage terminal ELVDD and the second voltage terminal ELVSS so that the driving sub-circuit 10 drives the light-emitting device EL to emit light). Therefore, the second reset sub-circuit 60 and the light-emitting control sub-circuit 40 can be controlled by the light-emitting signal Vem to realize their respective functions. In this way, there is no need to provide additional signal terminals and wires for the second reset sub-circuit 60. Therefore, the number of wires of the display panel where the pixel driving circuit 141 is located may be reduced, and a structure of the display panel may be simplified.

In some other embodiments, referring to FIGS. 10 and 11, the gate of the third switching transistor STFT3 is electrically connected to the first reset signal terminal RE1 or the second reset signal terminal RE2. In this case, the first switching transistor STFT1 to the sixth switching transistor STFT6 and the driving transistor DTFT are all transistors of a same type, for example, are all N-type thin film transistors, or are all P-type thin film transistors. Herein, FIGS. 10 and 11 are only illustrations by taking an example in which the first switching transistor STFT1 to the sixth switching transistor STFT6 are all N-type thin film transistors.

The pixel driving circuit 101 will be fully described with examples below with reference to FIGS. 10 to 12. The pixel driving circuit 101 includes the first switching transistor STFT1, the second switching transistor STFT2, the third switching transistor STFT3, the fourth switching transistor STFT4, the fifth switching transistor STFT5, the sixth switching transistor STFT6, the driving transistor DTFT and the capacitor Cst.

The gate of the first switching transistor STFT1 is electrically connected to the scanning signal terminal GATE, the second electrode D of the first switching transistor STFT1 is electrically connected to the second electrode of the driving transistor DTFT, and the first electrode C of the first switching transistor STFT1 is electrically connected to the first terminal of the capacitor Cst.

The gate of the second switching transistor STFT2 is electrically connected to the first reset signal terminal RE1, the first electrode of the second switching transistor STFT2 is electrically connected to the first voltage terminal ELVDD, and the second electrode of the second switching transistor STFT2 is electrically connected to the gate of the driving transistor DTFT and the first terminal of the capacitor Cst.

The gate of the third switching transistor STFT3 is electrically connected to the first reset signal terminal RE1 (referring to FIG. 10), or the second reset signal terminal RE2 (referring to FIG. 11), or the light-emitting signal terminal EM (referring to FIG. 12), the first electrode of the third switching transistor STFT3 is electrically connected to the initialization voltage signal terminal VINIT, and the second electrode of the third switching transistor STFT3 is electrically connected to the second terminal of the capacitor Cst and the first electrode A of the light-emitting device EL.

The gate of the fourth switching transistor STFT4 is electrically connected to the scanning signal terminal GATE, the first electrode of the fourth switching transistor STFT4 is electrically connected to the data signal terminal DATA, and the second electrode of the fourth switching transistor STFT4 is electrically connected to the first electrode of the driving transistor DTFT.

The gate of the fifth switching transistor STFT5 is electrically connected to the light-emitting signal terminal EM, the first electrode of the fifth switching transistor STFT5 is electrically connected to the first voltage terminal ELVDD, and the second electrode of the fifth switching transistor STFT5 is electrically connected to the first electrode of the driving transistor DTFT.

The gate of the sixth switching transistor STFT6 is electrically connected to the light-emitting signal terminal EM, the first electrode of the sixth switching transistor STFT6 is electrically connected to the second electrode of the driving transistor DTFT, and the second electrode of the sixth switching transistor DTFT6 is electrically connected to the first electrode A of the light-emitting device EL and the second terminal of the capacitor Cst.

The gate of the driving transistor DTFT is electrically connected to the first terminal of the capacitor Cst.

It will be noted that, in a case where the driving transistor DTFT is turned on and the first switching transistor STFT1 and the fourth switching transistor STFT4 are turned on under control of the scanning signal Vgate, the turned-on driving transistor DTFT is equivalent to a turned-on diode. Here, the voltage of the first voltage signal Vdd is higher than the voltage of the data signal Vdata from the data signal terminal DATA. That is to say, the voltage at the first terminal of the capacitor Cst is higher than the voltage at the data signal terminal DATA. In this way, the first terminal of the capacitor Cst will discharge to the data signal terminal DATA. The discharging process will last until the voltage difference Vgs between the gate and the first electrode of the driving transistor DTFT drops to be equal to the threshold voltage Vth of the driving transistor DTFT, and then the driving transistor DTFT is turned off. When the driving transistor DTFT is turned off, the voltage at the first terminal of the capacitor Cat is a sum of Vdata and Vth. As a result, the voltage of the capacitor Cst is compensated with the threshold voltage Vth of the driving transistor DTFT.

Since distances from different sub-pixels located in different regions of the display apparatus to the first voltage terminal ELVDD or the second voltage terminal ELVSS are different, voltage drops (also referred as IR-Drop) of first voltage signals Vdd or second voltage signals Vss provided to the different sub-pixels are also different. As a result, voltages of the first voltage signals Vdd or the second voltage signals Vss actually received by the different sub-pixels located in different regions are different. In the related art, a data signal Vdata' written into a capacitor may be affected by a first voltage signal Vdd' or the second voltage signal Vss'. As a result, there is a difference in the driving current of the light-emitting device in different sub-pixels located in different regions, which makes the brightness of the display apparatus more uneven.

In the pixel driving circuit 101 provided in some embodiments of the present disclosure, after the data signal Vdata is written, the voltage at the first terminal of the capacitor Cst is a sum of Vdata and Vth, and the voltage at the second terminal of the capacitor Cst is Vint. Therefore, the data signal Vdata written into the capacitor Cst is unrelated to the first voltage signal Vdd or the second voltage signal Vss, and a brightness uniformity of the display apparatus is improved.

In addition, when the second switching transistor STFT2 and the third switching transistor STFT3 are turned on, the initialization voltage signal Vinit is output to the second terminal of the capacitor Cst through the third switching transistor STFT3, and the first voltage signal Vdd is output to the first terminal of the capacitor Cat through the second switching transistor STFT2. In this way, the capacitor Cat may be reset, and the data signal Vdata written into the driving sub-circuit 10 in the previous image frame may have a low impact or no impact on image display in the current image frame. Since the first terminal of the capacitor Cst is electrically connected to the gate of the driving transistor DTFT, the voltage at the gate of the driving transistor DTFT may also be reset in the above process.

In addition, in a case where the second switching transistor STFT2 and the third switching transistor STFT3 are respectively controlled by different signals (for example, the third switching transistor STFT3 is controlled by the second reset signal terminal RE2 or by the light-emitting signal terminal EM), voltages at the first terminal and the second terminal of the capacitor Cst are respectively reset by different signals. Therefore, when the data signal Vdata is being written into the capacitor Cst, the second reset signal terminal RE2 or the light-emitting signal terminal EM is still able to control the initialization voltage signal Vinit to be output to the first electrode A of the light-emitting device EL to reset it without affecting the data signal Vdata written into the second terminal of the capacitor Cst. In this way, a reset time of the light-emitting device EL is prolonged, the number of carriers that do not recombine in the light-emitting layer inside the light-emitting device EL may be reduced, and the aging of the light-emitting device EL may be slowed down.

As shown in FIGS. 8, 13 and 15, in some embodiments of the present disclosure, a pixel driving method is provided. The method may be applied to the pixel driving circuit 101 described above. The pixel driving method includes the following steps in a writing and compensation period P2 and a light-emitting period P3 within an image frame.

In the writing and compensation period P2, the data writing sub-circuit 20 writes the data signal Vdata into the driving sub-circuit 10 under control of the scanning signal Vgate, and the compensation sub-circuit 30 compensates the voltage of the driving sub-circuit 10 under control of the scanning signal Vgate.

In the light-emitting period P3, the light-emitting control sub-circuit 40 turns on the line, on which the light-emitting device EL is located, between the first voltage terminal ELVDD and the second voltage terminal ELVSS under control of the light-emitting signal Vem, and the driving sub-circuit 10 drives the light-emitting device EL to emit light according to the written data signal Vdata.

The pixel driving method has the same advantages as the pixel driving circuit 101. Since the advantages have been described in detail in the description of the pixel driving circuit 101, they will not be elaborated herein again.

In some embodiments, as shown in FIGS. 10 to 15, the pixel driving circuit 101 further includes the first reset sub-circuit 50 and the second reset sub-circuit 60. The pixel driving method further includes steps in a reset period P1 within the image frame.

In the reset period P1, the first reset sub-circuit 50 transmits the first voltage signal Vdd to the first terminal T1 of the driving sub-circuit 10 under control of the first reset signal Vre1 and the second reset sub-circuit 60 transmits an initialization voltage signal Vinit from the initialization voltage signal terminal VINIT to the third terminal T3 of the driving sub-circuit 10 and the first electrode A of the light-emitting device EL under control of one of the first reset signal Vre1, the second reset signal Vre2 and the light-emitting signal Vein.

In some embodiments, as shown in FIG. 14, the second reset sub-circuit 60 transmits the initialization voltage signal Vinit to the third terminal T3 of the driving sub-circuit 10 and the first electrode A of the light-emitting device EL under control of the first reset signal Vre1 from the first reset signal terminal RE1 (referring to FIG. 10) or the light-emitting signal Vem from the light-emitting signal terminal EM (referring to FIG. 12).

In the reset period P1, the first reset signal Vre1 is a first-level signal, and the scanning signal Vgate, the light-emitting signal Vem, and the data signal Vdata are second-level signals.

In the writing and compensation period P2, the scanning signal Vgate and the data signal Vdata are first-level signals, and the first reset signal Vre1 and the light-emitting signal Vem are second-level signals.

In the light-emitting period P3, the light-emitting signal Vem is the first-level signal, and the first reset signal Vre1, the scanning signal Vgate, and the data signal Vdata are second-level signals.

On this basis, in some embodiments, referring to FIG. 12, the second reset sub-circuit 60 is controlled by the light-emitting signal. Vem. In the writing and compensation period P2, the second reset sub-circuit 60 transmits the initialization voltage signal Vinit to the third terminal T3 of the driving sub-circuit 10 and the first electrode A of the light-emitting device EL under the control of the light-emitting signal Vem.

In this way, in the reset period P1 and the writing and compensation period P2, the light-emitting signal Vem is a second-level signal, and the second reset sub-circuit 60 continues resetting the third terminal T3 of the driving sub-circuit 10 and the first electrode A of the light-emitting device EL throughout the reset period P1 and the writing and compensation period P2. Therefore, the reset time of the first electrode A of the light-emitting device EL is long and the reset is sufficient, so that the aging of the light-emitting device EL may be slowed down.

For another example, referring to FIGS. 11 and 13, the second reset sub-circuit 60 transmits the initialization voltage signal Vinit to the third terminal T3 of the driving sub-circuit 10 and the first electrode A of the light-emitting device EL under control of the second reset signal Vre2.

In the writing and compensation period P2, the second reset sub-circuit 60 transmits the initialization voltage signal Vinit to the third terminal T3 of the driving sub-circuit 10 and the first electrode A of the light-emitting device EL under control of the second reset signal Vre2.

In this case, the exemplary timing of each signal is shown in FIG. 13. In the reset period P1, the first reset signal Vre1 and the second reset signal Vre2 are first-level signals, and the scanning signal Vgate, the light-emitting signal Vem and the data signal Vdata are second-level signals.

In the writing and compensation period P2, the second reset signal Vre2, the scanning signal Vgate and the data signal Vdata are first-level signals, and the first reset signal Vre1 and the light-emitting signal Vem are second-level signals.

In the light-emitting period P3, the light-emitting signal Vem is a first-level signal, and the first reset signal Vre1, the second reset signal Vre2, the scanning signal Vgate, and the data signal Vdata are second-level signals.

In this way, in the reset period P1 and the writing and compensation period P2, the second reset signal Vre2 is a high-level signal, and the second reset sub-circuit 60 continues resetting the third terminal T3 of the driving sub-circuit 10 and the first electrode A of the light-emitting device EL throughout the reset period P1 and the writing and compensation period P2. Therefore, the reset time of the first electrode A of the light-emitting device EL is long and the reset is sufficient, so that the aging of the light-emitting device EL may be slowed down.

A working process of the pixel driving circuit 101 overall will be described in an exemplary manner below with the pixel driving circuit 101 in FIG. 11 as an example in combination with the timing of each signal in FIG. 13.

Herein, the first switching transistor STFT1 to the sixth switching transistor STFT6 and the driving transistor DTFT included in the pixel driving circuit 101 are all N-type thin film transistors. That is, the transistors are all turned on under control of a high-level signal and turned off under control of a low-level signal. Herein, an example is taken in which the first voltage signal Vdd provided by the first voltage terminal ELVDD is a high-level signal, and the second voltage signal Vss provided by the second voltage signal terminal ELVSS is a low-level signal. The first voltage signal Vdd and the second voltage signal Vss are both constant voltage signals.

In addition, for convenience of description, the first terminal T1 of the driving sub-circuit 10 is defined as a first node, and a voltage at the first node equals to a voltage at the first terminal of the capacitor Cst and a voltage at the gate of the driving transistor DTFT. The second terminal T2 of the driving sub-circuit 10 is defined as a second node, and a voltage at the second node equals to a voltage at the second electrode of the driving transistor DTFT. The third terminal T3 of the driving sub-circuit 10 is defined as a third node, and a voltage at the third node equals to a voltage at the second terminal of the capacitor Cst. The fourth terminal T4 of the driving sub-circuit 10 is defined as a fourth node, and a voltage at the fourth node equals to a voltage at the first electrode of the driving transistor DTFT.

The pixel driving circuit 101 has a reset period P1, a writing and compensation period P2, and a light-emitting period P3 within an image frame. In the following, "1" represents a high-level signal, and "0" represents a low-level signal.

In the reset period P1, Vre1=1, Vre2=1, Vgate=0, Vem=0, and Vdata=0. The first reset signal Vre1 is a high-level signal, and thus the second switching transistor STFT2 is turned on. The second reset signal Vre2 is a high-level signal, and thus the third switching transistor STFT3 is turned on. The scanning signal Vgate is a low-level signal, and thus the first switching transistor STFT1 and the fourth switching transistor STFT4 are turned off. The light-emitting signal Vem is a low-level signal, and thus the fifth switching transistor STFT5 and the sixth switching transistor STFT6 are turned off.

The first voltage signal Vdd provided by the first voltage signal terminal ELVDD is transmitted to the first node through the turned-on second switching transistor STFT2, and the voltage V1 at the first node is Vdd. At the same time, the initialization voltage signal Vinit provided by the initialization voltage signal terminal VINIT is transmitted to the third node through the turned-on third switching transistor STFT3, and the voltage V3 at the third node is Vinit. In the meantime, the gate voltage Vg of the driving transistor DTFT is equal to Vdd (i.e., Vg=Vdd), and the driving transistor DTFT is turned on. The voltage at the first terminal of the capacitor Cat is Vdd, and the voltage at the second terminal of the capacitor Cst and the voltage at the first electrode A of the light-emitting device EL are Vinit. Since the fifth switching transistor SIFTS and the sixth switching transistor STFT6 are turned off, the line between the first voltage signal terminal ELVDD and the second voltage signal terminal ELVSS are not turned on, and the light-emitting device EL does not emit light.

In the compensation period P2, Vre1=0, Vre2=1, Vgate=1, Vem=0, and Vdata=1. The first reset signal Vre1 is a low-level signal, and thus the second switching transistor STFT2 is turned off. The second reset signal Vre2 is still a high-level signal, and thus the third switching transistor STFT3 is still turned on. The scanning signal Vgate is a high-level signal, and thus the first switching transistor STFT1 and the fourth switching transistor STFT4 are turned on. The light-emitting signal Vem is a low-level signal, and thus the fifth switching transistor STFT5 and the sixth switching transistor STFT6 are turned off.

When the writing and compensation period P2 begins, the voltage at the first terminal of the capacitor Cst will not jump and is still Vdd. Therefore, the voltage at the first node does not change sharply and is still Vdd at a beginning of the writing and compensation period P2, and the driving transistor DTFT is still turned on. The data signal Vdata provided by the data signal terminal DATA is transmitted to the fourth node through the turned-on fourth switching transistor STFT4, and therefore the voltage at the fourth node is Vdata. The voltage at the first terminal of the capacitor Cst is Vdd, which is higher than the voltage of the data signal Vdata. Therefore, the first terminal of the capacitor Cat is discharged to the fourth node through the turned-on driving transistor DTFT and the turned-on first transistor STFT1. In the discharging process, the voltage at the first terminal of the capacitor Cst continues to decrease, and thus the voltage at the first node continues to decrease. When the voltage at the first node decreases from Vdd to a sum of Vdata and Vth (herein Vth represents the threshold voltage of the driving transistor DTFT), the voltage difference Vgs between the gate voltage Vg and the voltage Vs at the second electrode of the driving transistor DTFT decreases to Vth. At this time, the driving transistor DTFT is turned off. The voltage at the first terminal of the capacitor Cst is the sum of Vdata and Vth. That is, the data voltage Vdata is written into the capacitor Cst, and the threshold voltage Vth of the driving transistor DTFT is compensated onto the data voltage Vdata.

In addition, the voltage at the second terminal of the capacitor Cst and the voltage at the first electrode A of the light-emitting device EL are still Vinit. That is, the voltage at the third node is still Vinit in the writing and compensation period P2. The line between the first voltage signal terminal ELVDD and the second voltage signal terminal ELVSS are not turned on, and the light-emitting device EL still does not emit light.

In the light-emitting period P3, Vre1=0, Vre2=0, Vgate=0, Vem=1, and Vdata=0. The first reset signal Vre1 and the second reset signal Vre2 are low-level signals, and thus the second switching transistor STFT2 and the third switching transistor STFT3 are turned off. The scanning signal Vgate is a low-level signal, and thus the first switching transistor STFT1 and the fourth switching transistor STFT4 are turned off. The light-emitting signal Vem is a high-level signal, and thus the fifth switching transistor STFT5 and the sixth switching transistor STFT6 are turned on.

The voltage at the first node is still a sum of Vdata and Vth. The voltage at the third node is still Vinit. The voltage at the second node is approximately equal to the voltage at the third node, which is Vinit. The voltage at the fourth node is Vdd. The gate voltage Vg of the driving transistor DTFT is a sum of Vdata and Vth, the first electrode voltage Vd of the driving transistor DTFT is Vdd, and the second electrode voltage Vs of the driving transistor DTFT is Vinit. At this time, a voltage difference Vgs between the gate voltage Vg and the second electrode voltage Vs is: Vgs=Vdata Vth Vinit. Since Vdata is greater than Vinit (the voltage of the data signal Vdata is greater than the initialization voltage signal Vinit), Vgs is greater than Vth at this time. That is, the driving transistor DTFT is turned on. Moreover, a voltage difference Vds between the first electrode voltage Vd and the second electrode voltage Vs is: Vds=Vdd−Vinit. A difference between the voltage difference Vgs and the voltage difference Vds is a difference between a sum of Vdata and Vth and Vdd (i.e., Vdata+Vth−Vdd), Since Vdd is greater than the Vdata (the voltage of the first voltage signal Vdd is greater than the voltage of the data signal Vdata), Vds is less than Vth. Thus, the driving transistor DTFT is in the saturation region.

At this time, the driving current for driving the light-emitting device EL is:

$$I=K(Vgs-Vth)^2=K(V\text{data}+Vth-V\text{init}-Vth)^2=K(V\text{data}-V\text{init})^2.$$

Herein, K is a constant and is a conductivity factor of the driving transistor DTFT. The voltage of the data signal Vdata and the voltage of the initialization voltage signal. Vinit hardly fluctuate, and the driving current I is unrelated to the first voltage signal Vdd, the second voltage signal Vss and the threshold voltage Vth of the driving transistor DTFT Therefore, the stability of the driving current I of the light-emitting device EL may be ensured, the stability and uniformity of the brightness of the light-emitting device EL may be improved, and the display apparatus may be guaranteed to have a good display effect.

For ease of understanding, regarding voltage changes at the four nodes in the image frame, reference may be made to Table 1 below.

TABLE 1

Voltage changes of each node within the image frame

| | Node | | | |
|---|---|---|---|---|
| Phase | N1 | N2 | N3 | N4 |
| P1 | Vdd | — | — | Vinit |
| P2 | Vdata + Vth | Vdata | Vdata + Vth | Vinit |
| P3 | Vdata + Vth + (Voled − Vinit) | Vdd | Voled | Voled |

In Table 1, after the reset period P1, the voltage at the first terminal of the capacitor Cst and the gate voltage of the driving transistor DTFT both become Vdd, and the voltage at the second terminal of the capacitor Cst and the voltage of the light-emitting device EL both become Vinit. After the writing and compensation period P2, the first electrode voltage Vd of the driving transistor DTFT becomes Vdata, the second electrode voltage Vs of the driving transistor DTFT, the gate voltage Vg of the driving transistor DTFT and the voltage at the first terminal of the capacitor Cst ail become (Vdata+Vth), and the voltage at the second terminal of the capacitor Cst and the first electrode voltage of the light-emitting device EL both become Vinit. After the light-emitting period P3, the gate voltage Vg of the driving transistor DTFT and the voltage at the first terminal of the capacitor Cst both become [Vdata+Vth+(Voled−Vinit)], the first electrode voltage Vd of the driving transistor DTFT becomes Vdd, and the second electrode voltage Vs of the driving transistor DTFT, the voltage at the second terminal of the capacitor Cst and the voltage of the light-emitting device EL all become Voled. Herein, Voled is a working voltage of the light-emitting device EL.

In some embodiments of the present disclosure, a display panel 100' is further provided. As shown in FIG. 16, the display panel 100' includes a plurality of sub-pixels P, and at least one sub-pixel P includes the pixel driving circuit 101 as described above and a corresponding light-emitting device EL.

The display panel provided in some embodiments of the present disclosure has the same beneficial effects as the beneficial effects of the pixel driving circuit 101 described above, which will not be repeated here.

In the description of the above embodiments, specific features, structures, materials or characteristics may be combined in any suitable manner in any one or more embodiments or examples.

The forgoing descriptions are merely specific implementation manners of the present disclosure, but the protection scope of the present disclosure is not limited thereto. A person skilled in the art could readily conceive of changes or replacements within the technical scope of the present disclosure, which shall be included in the protection scope of the present disclosure. Therefore, the protection scope of the present disclosure shall be subject to the protection scope of the claims.

What is claimed is:

1. A pixel driving circuit, comprising a driving sub-circuit, a data writing sub-circuit, a compensation sub-circuit, a light-emitting control sub-circuit, a first reset sub-circuit and a second reset sub-circuit wherein the driving sub-circuit is configured to drive a light-emitting device to emit light;

the data writing sub-circuit is electrically connected to the driving sub-circuit, and is configured to write a data signal from a data signal terminal to the driving sub-circuit in response to a scanning signal from a scanning signal terminal;

the compensation sub-circuit is electrically connected to the driving sub-circuit, and is configured to compensate a voltage of the driving sub-circuit in response to the scanning signal, wherein the compensation sub-circuit includes:

a first switching transistor, a gate of the first switching transistor being electrically connected to the scanning signal terminal, a first electrode of the first switching transistor being electrically connected to a first terminal of the driving sub-circuit, and a second electrode of the first switching transistor being electrically connected to a second terminal of the driving sub-circuit; and the first switching transistor being an indium gallium zinc oxide thin film transistor;

the light-emitting control sub-circuit is electrically connected to the driving sub-circuit, and is configured to turn on a line, on which the light-emitting device is located, between a first voltage terminal and a second voltage terminal in response to a light-emitting signal from a light-emitting signal terminal, so as to allow the driving sub-circuit to drive the light-emitting device to emit light; and the first reset sub-circuit is electrically connected to the driving sub-circuit, wherein the first reset sub-circuit is configured to transmit a first voltage signal from the first voltage terminal to the first terminal of the driving sub-circuit in response to a first reset signal from a first reset signal terminal, wherein the first reset sub-circuit includes:

a second switching transistor, a gate of the second switching transistor being electrically connected to the first reset signal terminal, a first electrode of the second switching transistor being electrically connected to the first voltage terminal, and a second electrode of the second switching transistor being electrically connected to the first terminal of the driving sub-circuit and the second switching transistor being an indium gallium zinc oxide thin film transistor;

the second reset sub-circuit is electrically connected to a third terminal of the driving sub-circuit, wherein in a writing and compensation period, the second reset sub-circuit is configured to transmit an initialization voltage signal from an initialization voltage signal terminal to the third terminal of the driving sub-circuit and a first electrode of the light-emitting device in response to the light-emitting signal.

2. The pixel driving circuit according to claim 1, wherein the data writing sub-circuit includes a fourth switching transistor; a gate of the fourth switching transistor is electrically connected to the scanning signal terminal, a first electrode of the fourth switching transistor is electrically connected to the data signal terminal, and a second electrode of the fourth switching transistor is electrically connected to a fourth terminal of the driving sub-circuit.

3. The pixel driving circuit according to claim 1, wherein the driving sub-circuit includes a driving transistor and a capacitor, wherein a gate of the driving transistor is electrically connected to a first terminal of the capacitor and the first reset sub-circuit, a first electrode of the driving transistor is electrically connected to the data writing sub-circuit and a first terminal of the light-emitting control sub-circuit, and a second electrode of the driving transistor is electrically connected to a second terminal of the light-emitting control sub-circuit and a second terminal of the compensation sub-circuit; and the first terminal of the capacitor is further electrically connected to a first terminal of the compensation sub-circuit, and a second terminal of the capacitor is electrically connected to the first electrode of the light-emitting device and the second reset sub-circuit.

4. The pixel driving circuit according to claim 1, wherein the light-emitting control sub-circuit includes a fifth switching transistor and a sixth switching transistor, wherein a gate of the fifth switching transistor is electrically connected to the light-emitting signal terminal, a first electrode of the fifth switching transistor is electrically connected to the first voltage terminal, and a second electrode of the fifth switching transistor is electrically connected to a fourth terminal of the driving sub-circuit;

a gate of the sixth switching transistor is electrically connected to the light-emitting signal terminal, a first electrode of the sixth switching transistor is electrically connected to the second terminal of the driving sub-circuit, and a second electrode of the sixth switching transistor is electrically connected to the first electrode of the light-emitting device.

5. The pixel driving circuit according to claim 4, wherein the second reset sub-circuit is capable of being responsive to the light-emitting signal;

the second reset sub-circuit includes a third switching transistor; a gate of the third switching transistor is electrically connected to the light-emitting signal terminal, a first electrode of the third switching transistor is electrically connected to the initialization voltage signal terminal, and a second electrode of the third switching transistor is electrically connected to the third terminal of the driving sub-circuit.

6. The pixel driving circuit according to claim 5, wherein the third switching transistor is one of a P-type thin film transistor and an N-type thin film transistor, and each of the fifth switching transistor and the sixth switching transistor is another of the P-type thin film transistor and the N-type thin film transistor.

7. The pixel driving circuit according to claim 1, wherein the second reset sub-circuit includes a third switching transistor, the data writing sub-circuit includes a fourth switching transistor, the light-emitting control sub-circuit includes a fifth switching transistor and a sixth switching transistor, and the driving sub-circuit includes a driving transistor and a capacitor, wherein the second electrode of the first switching transistor is electrically connected to a second electrode of the driving transistor, and the first electrode of the first switching transistor is electrically connected to a first terminal of the capacitor;

the second electrode of the second switching transistor is electrically connected to a gate of the driving transistor and the first terminal of the capacitor;

a gate of the third switching transistor is electrically connected to the light-emitting signal terminal, a first electrode of the third switching transistor is electrically connected to the initialization voltage signal terminal, and a second electrode of the third switching transistor is electrically connected to a second terminal of the capacitor and the first electrode of the light-emitting device;

a gate of the fourth switching transistor is electrically connected to the scanning signal terminal, a first electrode of the fourth switching transistor is electrically connected to the data signal terminal, and a second electrode of the fourth switching transistor is electrically connected to a first electrode of the driving transistor;

a gate of the fifth switching transistor is electrically connected to the light-emitting signal terminal, a first electrode of the fifth switching transistor is electrically connected to the first voltage terminal, and a second electrode of the fifth switching transistor is electrically connected to the first electrode of the driving transistor;

a gate of the sixth switching transistor is electrically connected to the light-emitting signal terminal, a first electrode of the sixth switching transistor is electrically connected to the second electrode of the driving transistor, and a second electrode of the sixth switching transistor is electrically connected to the first electrode of the light-emitting device and the second terminal of the capacitor; and the gate of the driving transistor is electrically connected to the first terminal of the capacitor.

8. The pixel driving circuit according to claim 7, wherein the third switching transistor is a P-type thin film transistor, and the first switching transistor, the second switching transistor, the fourth switching transistor, the fifth switching transistor, the sixth switching transistor and the driving transistor are all N-type thin film transistors.

9. A pixel driving method of the pixel driving circuit according to claim 1, the pixel driving method comprising:

in a writing and compensation period of an image frame:

writing, by the data writing sub-circuit, the data signal to the driving sub-circuit under control of the scanning signal, and compensating, by the compensation sub-circuit, the voltage of the driving sub-circuit under control of the scanning signal;

in a light-emitting period of the image frame:

turning on, by the light-emitting control sub-circuit, the line, on which the light-emitting device is located, between the first voltage terminal and the second voltage terminal under control of the light-emitting signal, and driving, by the driving sub-circuit, the light-emitting device to emit light according to a written data signal; and in a reset period of the image frame:

transmitting, by the first reset sub-circuit, the first voltage signal to the first terminal of the driving sub-circuit under control of a first reset signal, and transmitting, by the second reset sub-circuit, an initialization voltage signal from an initialization voltage signal terminal to the third terminal of the driving sub-circuit and a first electrode of the light-emitting device under control of the light-emitting signal;

the pixel driving method further includes:

in the writing and compensation period, transmitting, by the second reset sub-circuit, the initialization voltage signal to the third terminal of the driving sub-circuit and the first electrode of the light-emitting device under control of the light-emitting signal.

10. A display panel, comprising a plurality of sub-pixels, at least one sub-pixel including the pixel driving circuit according to claim 1 and a corresponding light-emitting device.

11. A display apparatus, comprising:

the display panel according to claim 10; and a display control device, wherein the display control device includes the scanning signal terminal, the data signal terminal, the light-emitting signal terminal, the first voltage terminal, and the second voltage terminal, and is configured to provide the scanning signal, the data signal, the light-emitting signal, a first voltage signal and a second voltage signal to the display panel.

* * * * *